US010108106B2

(12) United States Patent
Akita et al.

(10) Patent No.: US 10,108,106 B2
(45) Date of Patent: Oct. 23, 2018

(54) IMAGE FORMING APPARATUS WITH TONER DISCHARGE OPERATION

(71) Applicant: CANON KABUSHIKI KAISHA, Tokyo (JP)

(72) Inventors: Masanori Akita, Toride (JP); Kyosuke Takahashi, Toride (JP); Atsushi Matsumoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/857,605

(22) Filed: Sep. 17, 2015

(65) Prior Publication Data

US 2016/0085197 A1 Mar. 24, 2016

(30) Foreign Application Priority Data

Sep. 19, 2014 (JP) ..... 2014-191455

(51) Int. Cl.
*G03G 15/08* (2006.01)
*G03G 21/10* (2006.01)
*G03G 15/00* (2006.01)

(52) U.S. Cl.
CPC ..... *G03G 15/0844* (2013.01); *G03G 15/556* (2013.01)

(58) Field of Classification Search
CPC ..... G03G 15/0844
See application file for complete search history.

(56) References Cited

U.S. PATENT DOCUMENTS 6,047,142 A * 4/2000 Donaldson ..... G03G 15/0848 399/27
7,177,557 B2 * 2/2007 Kreckel ..... G03G 15/0844 399/257

(Continued)

FOREIGN PATENT DOCUMENTS

JP 2000-310909 A 11/2000
JP 2006-023327 A 1/2006

(Continued)

*Primary Examiner* — Clayton E Laballe
*Assistant Examiner* — Leon W Rhodes, Jr.
(74) *Attorney, Agent, or Firm* — Canon U.S.A., Inc. IP Division

(57) ABSTRACT

An image forming apparatus includes an image bearing member, a developing device, a supplying device, and a control unit. The image bearing member bears a latent image. The developing device develops the latent image with a toner. The supplying device supplies toner to the developing device. The control unit executes a discharge operation to consume toner transferred onto the image bearing member from the developing device without transferring the toner onto a recording medium. The control unit executes the discharge operation where first deterioration integrated information exceeds a first executing threshold, and where second deterioration integrated information exceeds a second executing threshold that is larger than the first executing threshold. The control unit acquires the first deterioration information based at least a first deterioration threshold, and acquires the second deterioration information based on at least a second deterioration threshold that is larger than the first deterioration threshold.

33 Claims, 19 Drawing Sheets

(56) References Cited

U.S. PATENT DOCUMENTS

| | | | | |
|---|---|---|---|---|
| 7,493,057 | B2 * | 2/2009 | Facci | G03G 15/0844 399/27 |
| 8,224,194 | B2 * | 7/2012 | Maruyama | G03G 15/553 399/257 |
| 8,401,406 | B2 * | 3/2013 | Nose | G03G 15/0844 399/27 |
| 2005/0025506 | A1 | 2/2005 | Adachi | |
| 2011/0052220 | A1 | 3/2011 | Nose | |

FOREIGN PATENT DOCUMENTS

| | | | | |
|---|---|---|---|---|
| JP | 2009025614 | A | | 2/2009 |
| JP | 2009282443 | A | | 12/2009 |
| JP | 2011048083 | A | | 3/2011 |
| JP | 4906895 | B2 | | 3/2012 |
| JP | 2012-093444 | A | | 5/2012 |
| JP | 2012103317 | A | * | 5/2012 |
| JP | 5506352 | B2 | | 5/2014 |
| JP | 2015-222395 | A | | 12/2015 |

* cited by examiner

FIG.12

<TONER REFRESH CONTROL (1)>

| | COLOR | | | |
|---|---|---|---|---|
| | Y | M | C | K |
| COVERAGE RATE (%) | 3 | 3 | 5 | 1 |
| VIDEO COUNT: V | 15 | 15 | 26 | 5 |
| TONER DETERIORATION THRESHOLD VIDEO COUNT: Vt | 10 | 10 | 10 | 10 |
| Vt – V | -5 | -5 | -16 | +5 |
| TONER DETERIORATION INTEGRATED VALUE PER SHEET: X | 0 | 0 | 0 | +5 |

FIG.13

<TONER REFRESH CONTROL (2)>

| | COLOR | | | |
|---|---|---|---|---|
| | Y | M | C | K |
| COVERAGE RATE (%) | 3 | 3 | 5 | 1 → 2 |
| VIDEO COUNT: V | 15 | 15 | 26 | 5 → 10 |
| TONER DETERIORATION THRESHOLD VIDEO COUNT: Vt | 26 | 26 | 26 | 26 |
| Vt – V | +11 | +11 | 0 | +16 |
| TONER DETERIORATION INTEGRATED VALUE PER SHEET: X' | +11 | +11 | 0 | +16 |

FIG.14

| COVERAGE RATE | TONER CHARGING AMOUNT |
|---|---|
| 1% | 50 μC/g |
| 2% | 47 μC/g |
| 5% | 43 μC/g |
| 10% | 40 μC/g |
| 20% | 37 μC/g |

IMAGE FORMING APPARATUS WITH TONER DISCHARGE OPERATION

BACKGROUND OF THE INVENTION

Field of the Invention

The present invention relates to an image forming apparatus including a developing device that develops an electrostatic latent image formed on an image bearing member of an electrophotographic copier, a laser beam printer, or the like, to develop a toner image.

Description of the Related Art

In conventional electrophotographic image forming apparatuses, when images with a low coverage rate are successively output, developer is stirred and rubbed for a while in a state where almost no toner is consumed and supplied in a developing device. For example, the developer is stirred by a developer conveyance screw that conveys the developer, and rubbed between a development sleeve and a doctor blade. As a result, an external additive provided to the toner for charge control and flowability control might be separated from the toner or embedded in a toner surface (hereinafter, also referred to as toner deterioration). The toner deterioration causes image quality degradation, such as a grainy effect, degrading printed image quality.

For example, Japanese Patent Application Laid-Open No. 2006-023327 and Japanese Patent Application Laid-Open No. 2000-310909 propose techniques that address this issue. More specifically, toner refreshing is performed by forcibly discharging deteriorated toner and supplying toner in an amount corresponding to the discharged amount, so that image quality is maintained.

When images with a low coverage rate are successively output, not only the image quality degradation due to the toner deterioration described above but also the following problem occurs. More specifically, when images with a high coverage rate are successively output immediately after the images with a low coverage rate are successively output, an image density largely fluctuates.

This is caused by a sharp change in a toner charging amount in the developing device due to switching from the successive low coverage rate image output to the successive high coverage rate image output. While the low coverage rate images are output, the toner charging amount is likely to be high due to excessive frictional charging between the toner and the carrier because the amount of toner exchanged in the developing device is small. On the other hand, while the high coverage rate images are output, the toner charging amount is likely to be low because a large amount of toner is consumed and supplied.

The refresh control discussed in Japanese Patent Application Laid-Open No. 2006-023327 and Japanese Patent Application Laid-Open No. 2000-310909 is effective against the image quality degradation due to the toner deterioration as a result of successively outputting the low coverage rate images. However, the refresh control might not be sufficiently effective against the density fluctuation caused by the change in the toner charging amount occurring when the low coverage rate image output is switched to the high coverage rate image output. This is because the two issues described above do not necessarily occur concurrently. More specifically, when the successive low coverage rate image output is performed, the conventional toner refresh control, executed at timing for preventing the image quality degradation due to the toner deterioration, might not be effective enough to prevent the image density fluctuation due to the change in the toner charging amount caused by switching of the coverage rates.

All things considered, an attempt to address the above two issues with the conventional refresh control only might lead to an unnecessarily toner consumption or an insufficient refreshing effect.

SUMMARY OF THE INVENTION

The present invention is for solving the issues described above. More specifically, the present invention is directed to providing an image forming apparatus that can prevent image quality degradation from occurring when low coverage rate images are successively formed or when successive low coverage rate image forming is switched to successive high coverage rate image forming. Toner refresh control is executed based on both a first threshold value for preventing deterioration of toner and a second threshold value for preventing concentration variations.

According to an aspect of the present invention, an image forming apparatus includes an image bearing member configured to bear a latent image, a developing device configured to develop the latent image formed on the image bearing member with a toner, a supplying device configured to supply toner to the developing device, and a control unit configured to execute a discharge operation to consume toner transferred onto the image bearing member from the developing device without transferring the toner onto a recording medium, wherein the control unit is configured to execute the discharge operation in a case where first deterioration integrated information obtained by integrating first deterioration information exceeds a first executing threshold, and in a case where second deterioration integrated information obtained by integrating second deterioration information exceeds a second executing threshold that is larger than the first executing threshold, wherein the control unit is configured to acquire the first deterioration information based on information related to a toner consumption amount acquired every time when a first predetermined condition is satisfied and a first deterioration threshold, and acquire the second deterioration information based on the information related to the toner consumption amount acquired every time when a second predetermined condition is satisfied and a second deterioration threshold, and wherein the second deterioration threshold is larger than the first deterioration threshold.

Further features of the present invention will become apparent from the following description of exemplary embodiments with reference to the attached drawings.

BRIEF DESCRIPTION OF THE DRAWINGS

FIG. 12 is a table illustrating toner refresh control (1) in the image forming apparatus according to the first exemplary embodiment.

FIG. 13 is a table illustrating toner refresh control (2) in the image forming apparatus according to the first exemplary embodiment.

FIG. 14 is a table illustrating toner charging amounts in successive image forming with various coverage rates in the image forming apparatus according to the first exemplary embodiment.

DESCRIPTION OF THE EMBODIMENTS

An image forming apparatus according to a first exemplary embodiment of the present invention is described in detail below.

<Overview of Image Forming Apparatus>

Figure 1:
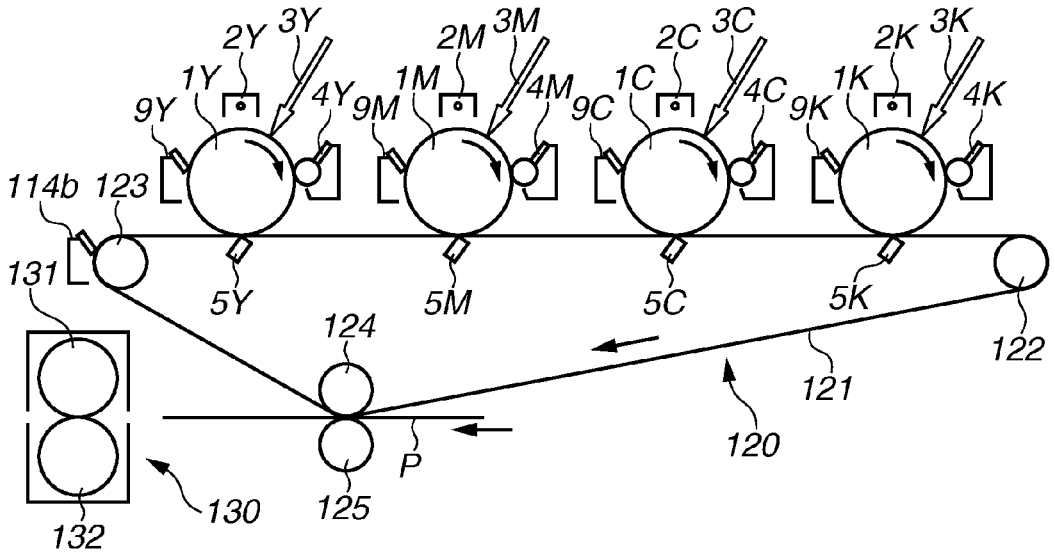
FIG. 1 is a schematic view illustrating an image forming apparatus according to a first exemplary embodiment.

As illustrated in FIG. 1, an image forming apparatus according to the present exemplary embodiment includes four image forming stations Y, M, C, and K respectively including photosensitive drums 1 (1Y, 1M, 1C, and 1K) as latent image bearing members. An intermediate transfer device 120 is disposed below the image forming stations. In the intermediate transfer device 120, an intermediate transfer belt 121, as an intermediate transfer member, is stretched around rollers 122, 123, and 124, and runs in a direction indicated by an arrow.

In the present exemplary embodiment, a surface of each of the photosensitive drums 1 (1Y, 1M, 1C, and 1K), charged by a corresponding one of primary charging devices (2Y, 2M, 2C, and 2K) employing a corona charging system for contactless charging, is exposed by a corresponding one of laser emitting devices 3 (3Y, 3M, 3C, and 3K) each being driven by a laser driver (not illustrated). Thus, electrostatic latent images are formed on the photosensitive drums 1 (1Y, 1M, 1C, and 1K), respectively. The latent images are developed by developing devices 4 (4Y, 4M, 4C, and 4K) as developing units, whereby yellow, magenta, cyan, and black toner images (developer images) are respectively formed.

The toner images, formed by the respective image forming stations, are transferred onto the intermediate transfer belt 121, made of polyimide resin, to be overlapped one on top of the other, by transfer bias applied by transfer blades 5 (5Y, 5M, 5C, and 5K) as primary transfer units. The four-color toner image thus formed on the intermediate transfer belt 121 is transferred onto a recording sheet P as a transfer material by a secondary transfer roller 125 as a secondary transfer unit facing the roller 124. Toner that is not transferred onto the recording sheet P and thus is remaining on the intermediate transfer belt 121 is removed by an intermediate transfer belt cleaner 114*b*. The recording sheet P onto which the toner image has been transferred is pressed/heated by a fixing device 130 including fixing rollers 131 and 132, whereby a permanent image is obtained. Primary transfer remaining toner, remaining on the photosensitive drums 1 after the primary transfer, is removed by cleaners 9 (9Y, 9M, 9C, and 9K). Thus, the image forming apparatus becomes ready for the next image forming.

<Configuration Around Photosensitive Drum in Image Forming Apparatus>

A configuration around each of the photosensitive drums 1 as the latent image bearing member of the image forming apparatus according to the present exemplary embodiment is described in detail with reference to FIG. 2. The configuration around the photosensitive drum 1 is the same among the colors, and thus the configuration corresponding to one of the colors will be representatively described.

Figure 2:
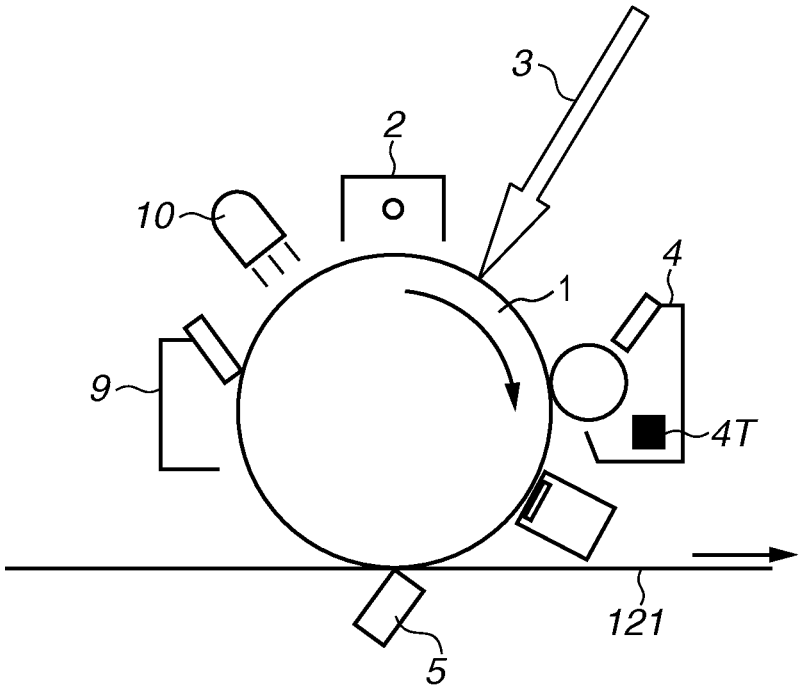
FIG. 2 is a diagram illustrating a configuration around a photosensitive drum in the image forming apparatus according to the present exemplary embodiment.

In FIG. 2, in the image forming apparatus according to the present exemplary embodiment, the photosensitive drum 1 as the electrostatic latent image bearing member is rotatably disposed. The surface of the photosensitive drum 1, uniformly charged by a contactless (corona) charging primary charging device 2, is exposed by the laser emitting device 3. Thus, an electrostatic latent image is formed on the photosensitive drum 1. The electrostatic latent image is visualized by the developing device 4. Then, the visible image is transferred onto the intermediate transfer belt 121 by the transfer blade 5. Transfer residual toner on the photosensitive drum 1 is removed by the cleaner 9 of a cleaning blade contacting type. Then, the potential on the photosensitive drum 1 is removed by a pre-exposure lamp 10 so that the photosensitive drum 1 is used again for forming the next image. The developing device 4 incorporates a bandgap temperature sensor 4T as a temperature detection unit for developer in the developing device 4.

<Overview of Image Processing>

A system configuration of an image processing unit in the image forming apparatus according to the present exemplary embodiment will be described with reference to a block diagram illustrated in FIG. 3.

Figure 3:
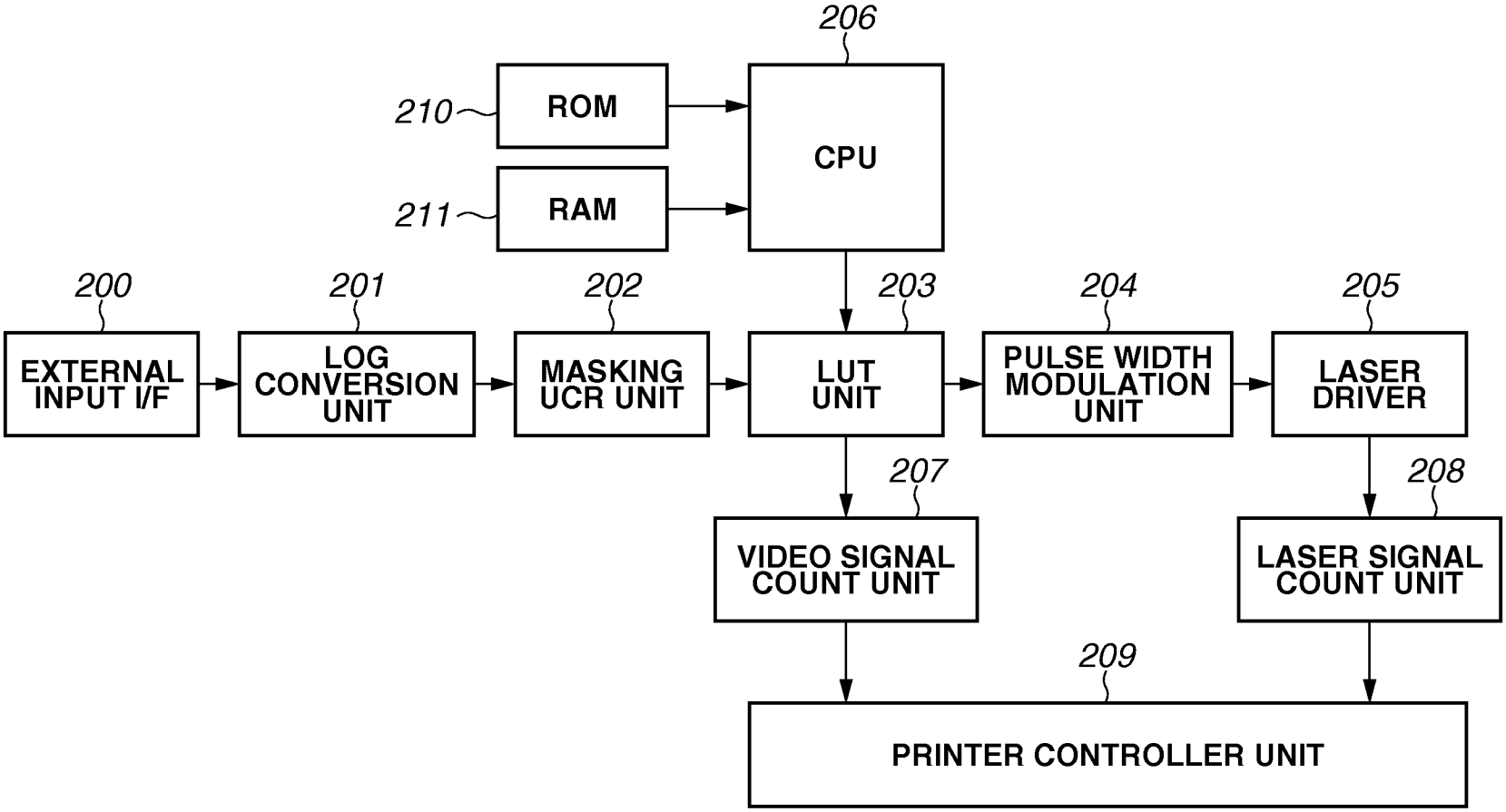
FIG. 3 is a block diagram illustrating a system configuration of an image processing unit in the image forming apparatus according to the present exemplary embodiment.

RGB image data as color image data from an external apparatus (not illustrated), such as a document scanner, a computer (information processing apparatus), or the like, is input through an external input interface (external input I/F) 200 in FIG. 3, as appropriate. A LOG conversion unit 201 converts brightness data of the input RGB image data into CMY density data (CMY image data), based on a lookup table (LUT) including data stored in a read only memory (ROM) 210 and the like. A masking under color removal (UCR) unit 202 extracts black (Bk) component data from the CMY image data and performs matrix calculation on CMKY image data to correct muddiness of recording color materials. An LUT unit 203 performs density correction on each color, in the input CMKY data, by using a gamma LUT with which image data conforms to ideal tone characteristics in a printer unit. The gamma LUT, the content of which is set by a central processing unit (CPU) 206, is generated based on data loaded onto a random access memory (RAM) 211. A pulse width modulation unit 204 outputs a pulse signal having a pulse width corresponding to a level of image data (image signal) input from the LUT unit 203. The laser driver 205 drives the laser emitting device 3 based on the pulse signal, whereby the photosensitive drum 1 is irradiated with a laser beam so that the electrostatic latent image is formed.

A video signal count unit 207 integrates levels (0 to 255 level) of respective pixels in a single image corresponding to 600 dpi image data input to the LUT unit 203. The image data integrated value is referred to as a video count. The maximum value of the video count, obtained when the levels of all the pixels in an output image are 255, is 512. When there is a limitation due to a circuit configuration, a laser signal count unit 208 may be used instead of the video signal count unit 207 to obtain the video count by performing a similar calculation on an image signal from the laser driver 205. The printer controller unit 209 controls each process unit to execute a discharge operation described below, based on the video count.

<Configuration of Developing Device>

Figure 4:
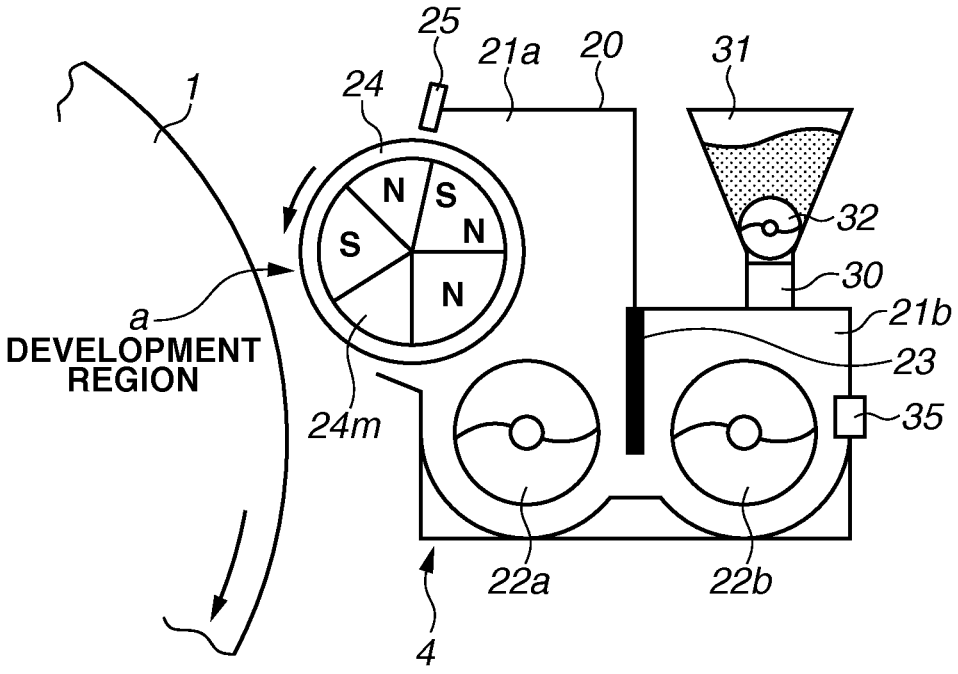
FIG. 4 is a first schematic view illustrating a developing device disposed in the image forming apparatus according to the present exemplary embodiment.
Figure 5:
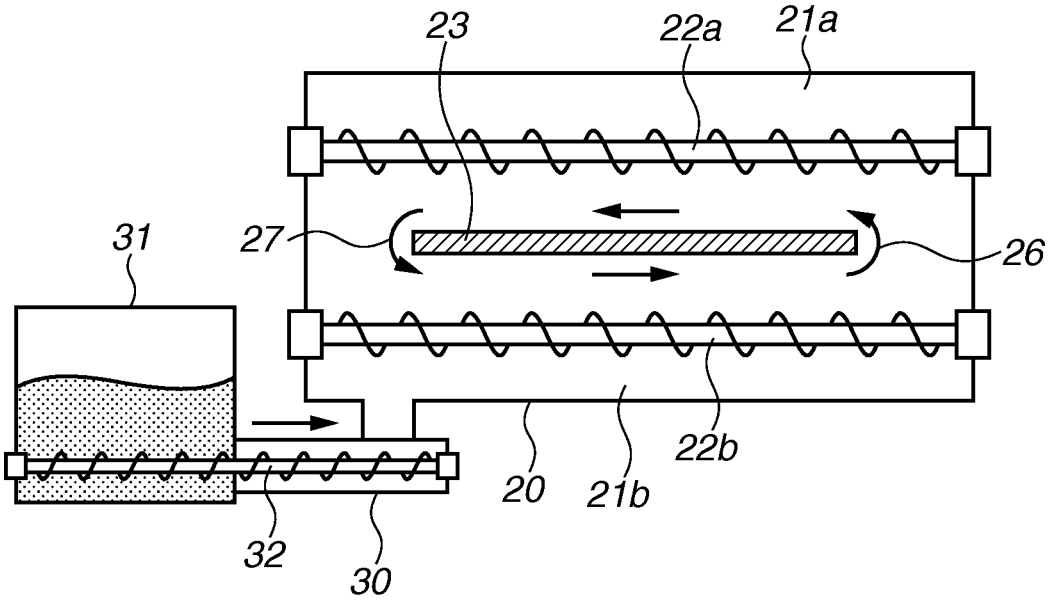
FIG. 5 is a second schematic view illustrating the developing device disposed in the image forming apparatus according to the present exemplary embodiment.

The developing device 4 is described more in detail with reference to FIGS. 4 and 5. In the present exemplary embodiment, the developing device 4 includes a developer container 20 containing two-component developer as developer including toner and carrier. The developer container 20 incorporates a development sleeve 24 as a developer bearing member (a toner bearing member) and a regulating blade (bristle-cutting member) 25 that regulates the bristle of the developer carried on the development sleeve 24.

In the present exemplary embodiment, the developer is contained in a developing chamber 21*a* and a stirring chamber 21*b* defined by dividing an internal space of the developer container 20 into left and right sides in a horizontal direction at a substantially center portion by a partition wall 23 extending in a vertical direction on the sheet surface of the figure.

The developing chamber 21*a* and the stirring chamber 21*b* respectively include first and second conveyance screws 22*a* and 22*b* as conveyance members each serving as a developer stirring and conveying unit. The first conveyance screw 22*a* is disposed in a bottom portion in the developing chamber 21*a* while being substantially parallel with an axial direction of the development sleeve 24. The first conveyance screw 22*a* rotates to convey the developer in the developing chamber 21*a* in one direction along the axial direction. The second conveyance screw 22*b* is disposed in a bottom portion in the stirring chamber 21*b* while being in parallel with the first conveyance screw 22*a*. The second conveyance screw 22*b* conveys the developer in the stirring chamber 21*b* in a direction opposite to the conveyance direction of the first conveyance screw 22*a*.

Through the conveyance by the rotation of the first and the second conveyance screws 22*a* and 22*b* described above, the developer is circulated between the developing chamber 21*a* and the stirring chamber 21*b*, through opening portions (that is, communication portions) and 27 (see FIG. 5) at both end portions of the partition wall 23.

Inside of the stirring chamber 21*b*, an inductance sensor 35 that detects a toner density of the two-component developer is disposed. Toner supplying is performed in accordance with a detection output from the inductance sensor 35. A method of controlling toner supplying is described in detail below.

In the present exemplary embodiment, the developing chamber 21*a* and the stirring chamber 21*b* are arranged on left and right sides in the horizontal direction. Alternatively, the present invention is applicable to a developing device in which the developing chamber 21*a* and the stirring chamber 21*b* are vertically arranged, or a developing device having other configurations.

In the present exemplary embodiment, the developer container 20 has an opening portion at a portion corresponding to a development region a facing the photosensitive drum 1. The development sleeve 24 is rotatably disposed at the opening portion in such a manner that the development sleeve 24 is partially exposed toward the photosensitive drum 1.

In the present exemplary embodiment, a diameter of the development sleeve 24 is 20 mm, a diameter of the photosensitive drum 1 is 80 mm, and a distance between the closest portions of the development sleeve 24 and the photosensitive drum 1 is about 400 μm. With this configuration, developing can be performed with the developer conveyed to the development region a in contact with the photosensitive drum 1. The development sleeve 24 is made of a nonmagnetic material, such as aluminum and stainless steel, and incorporates a magnet roller 24*m*, as a magnetic field unit, in a non-rotatable state.

A regulating blade 25 as the bristle-cutting member is a nonmagnetic member made of an aluminum plate or the like extending in a longitudinal axial direction of the development sleeve 24. The regulating blade 25 is disposed on an upstream side of the photosensitive drum 1 in the rotation direction of the development sleeve 24. The toner and the carrier of the developer both pass through a gap between a distal end portion of the regulating blade 25 and the development sleeve 24 to be conveyed to the development region a.

By adjusting the gap between the regulating blade 25 and a surface of the development sleeve 24, an amount of bristle cutting by a magnetic brush for the developer held on the development sleeve 24 is regulated. Thus, an amount of the developer conveyed to the development region a is adjusted. In the present exemplary embodiment, the regulating blade 25 regulates a developer coating amount per unit area on the development sleeve 24 to 30 mg/cm$^2$.

The gap between the regulating blade 25 and the development sleeve 24 is set to 200 to 1000 μm and is preferably 300 to 700 μm. In the present exemplary embodiment, the gap is set to 500 μm.

In the development region a, the development sleeve 24 of the developing device 4 rotates in a direction conforming to the rotation direction of the photosensitive drum 1, at a rotational speed that is 1.75 times as high as that of the photosensitive drum. The rotational speed may be set to any value that is 1.3 to 2.0 times as high as that of the photosensitive drum 1. A higher rotational speed of the development sleeve 24 can achieve higher development efficiency. However, an excessively high rotational speed causes problems, such as toner scattering and developer deterioration. Thus, the rotational speed is preferably set to be within the range described above.

The bandgap temperature sensor 4T is disposed in the opening portion (that is, the communication portion) 26 in the developer container 20. The bandgap temperature sensor 4T serves as a temperature detection unit that detects information on the temperature in the developing device 4. The bandgap temperature sensor 4T is disposed in the developer in the developing device 4, and thus directly detects the temperature of the developer. The temperature sensor 4T is preferably disposed at a position in the developer container 20 where a sensor surface is immersed in the developer to achieve highly accurate detection. However, the disposed position of the temperature sensor T4 is not limited to this. The temperature in the developing device 4 may be detected with a slightly lower accuracy by a temperature sensor disposed in an image forming apparatus main body.

Figure 6:
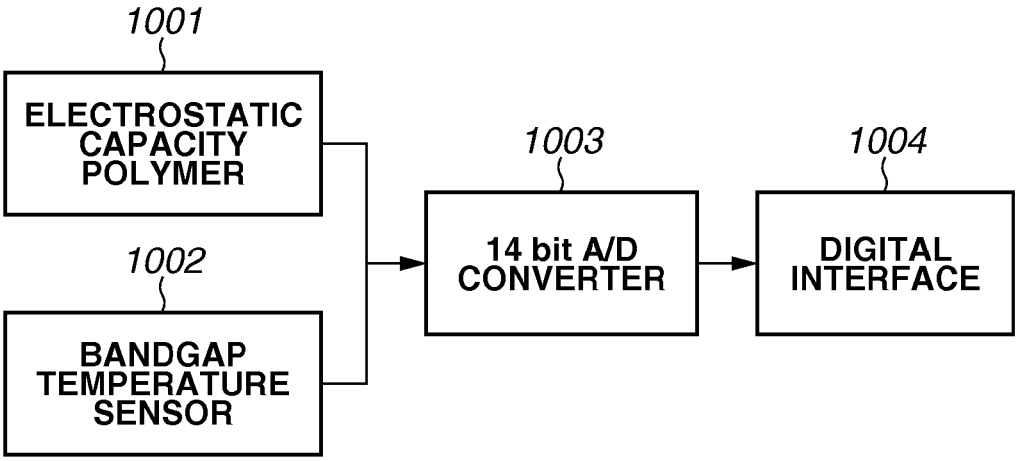
FIG. 6 is a block diagram illustrating a control block configuration example of a temperature sensor disposed in the image forming apparatus according to the present exemplary embodiment.

The temperature sensor 4T is described in detail. In the present exemplary embodiment, a temperature and humidity sensor SHT1x-series, manufactured by Sensirion AG, is used as the temperature sensor 4T. As illustrated in FIG. 6, the temperature sensor 4T includes a sensing element of an electrostatic capacity polymer 1001 as a humidity detection device and a bandgap temperature sensor 1002 as a temperature detection device, each of which is a complementary metal-oxide-semiconductor (CMOS) device that is coupled to a 14 bit A/D converter 1003 and performs a serial output through a digital interface 1004. The bandgap temperature sensor 1002, as a temperature detection device, uses a thermistor resistance of which linearly changes in accordance with a temperature and thus calculates the temperature from the resistance. The electrostatic capacity polymer 1001, as a humidity detection device, is a capacitor in which a polymer as a dielectric member is inserted. The electrostatic capacity polymer 1001 detects a humidity converted from an electrostatic capacity of the capacitor that linearly changes with respect to the humidity because the amount of moisture adsorbed to the polymer changes in accordance with the humidity.

In the configuration described above, the development sleeve 24 rotates in a direction indicated by an arrow in the figure (counterclockwise direction) when the developing is performed. The development sleeve 24 bears the two-component developer, the layer thickness of which is regulated by the bristle cutting by the regulating blade 25 using the magnetic brush. The development sleeve 24 conveys the developer, the layer thickness of which is regulated, to the development region a facing the photosensitive drum 1. Thus, the developer is supplied to the electrostatic latent image, formed on the photosensitive drum 1, whereby the latent image is developed. In this process, a power source applies development bias voltage, in which DC voltage and AC voltage superimposed on each other, to the development sleeve 24, whereby development efficiency is improved, that is, attraction of the toner to the latent image is facilitated. In the present exemplary embodiment, a DC voltage of −500 V and an AC voltage with peak to peak voltage Vpp of 1800 V and a frequency f of 12 kHz are used.

In the first exemplary embodiment, a potential difference between the DC voltage value and an exposure potential (that is, a solid portion potential) obtained by the laser emitting device 3 is controlled in such a manner that a toner amount per unit area on the photosensitive drum 1 for forming a solid image is set to be 0.5 mg/cm$^2$. Generally, when the AC voltage is applied to improve the development efficiency in a method using the two-component developer and the magnetic brush, a high quality image can be obtained but fogging is likely to occur. Thus, the fogging is prevented by providing a potential difference between the DC voltage applied to the development sleeve 24 and the charging potential on the photosensitive drum 1 (that is, a blank portion potential).

<Overview of Developer in Developing Device>

Here, the two-component developer, including toner and carrier, contained in the developer container 20 of the developing device 4 according to the present exemplary embodiment is described in detail.

The toner includes coloring resin particles, including a binder resin, a coloring agent, and any other additives as appropriate, as well as coloring particles to which external additives, such as colloidal silica fine powder, are externally added. The toner is negatively charged polyester resin. A volume average particle diameter of the toner is preferably equal to or larger than 4 μm and equal to or smaller than 10 μm, and is more preferably equal to or smaller than 8 μm.

As the carrier, metal such as iron, nickel, cobalt, manganese, chrome, and rare earth elements with an oxidized or non-oxidized surface, an alloy of these, oxide ferrite, or the like may be favorably used. A method of manufacturing these magnetic particles is not particularly limited. A weight average particle diameter of the carrier is 20 to 60 μm, and is preferably 30 to 50 μm. A resistivity of the carrier is equal to or larger than $10^7$ Ωcm, and is preferably equal to or larger than $10^8$ Ωcm, which is a case in the present exemplary embodiment.

The volume average particle diameter of the toner used in the present exemplary embodiment is measured in devices and a method described below. As the measurement devices, a coulter counter model TA-II (manufactured by Beckman Coulter, Inc.), an interface for outputting a number average particle diameter distribution and a volume average particle diameter distribution (manufactured by Nikkaki Bios Co., Ltd.), and a personal computer CX-I (manufactured by Canon Inc.) are used. As electrolytic aqueous solution, 1% NaCl solution prepared by using primary sodium chloride is used.

In the present exemplary embodiment, the two-component developer obtained by mixing the toner and the carrier at a weight percent ratio (toner/(toner+carrier)) of 8%, and 400 g of the two-component developer is filled in the developing device 4.

The measurement method is described below. To the electrolytic aqueous solution in an amount of 100 to 150 ml, surface active agent, preferably alkyl benzene sulfonate, in an amount of 0.1 ml is added as dispersant, and a measured sample in an amount of 0.5 to 50 mg is added. The electrolytic aqueous solution in which the sample is suspended is subjected to dispersion processing for about 1 to 3 minutes in an ultrasonic dispersion device. Then, with 100 μm aperture of the coulter counter model TA-II, a particle diameter distribution of particles of 2 to 40 μm is measured to obtain a volume average particle diameter distribution. The volume average particle diameter is obtained from the volume average particle diameter distribution thus obtained.

To measure the carrier resistivity used in the present exemplary embodiment, a sandwich type cell with a measurement electrode surface of 4 cm and an inter-electrode distance of 0.4 cm is used. The carrier resistivity is measured from current flowing in a circuit as a result of applying applied voltage E (V/cm) between the electrodes with a weight of 1 kg applied to one of the electrodes.

<Developer Supplying Method in Developing Device>

A developer supplying method in the present exemplary embodiment is described with reference to FIGS. 4 and 5.

A hopper 31 containing the two-component developer as a mixture of toner and carrier is disposed in an upper portion of the developing device 4. The hopper 31, forming a toner supplying unit (supplying device), includes a supplying screw 32 as a supplying member in a form of a screw in a lower portion. The supplying screw 32 has one end extending to a position of a developer supplying port 30 disposed at a front end portion of the developing device 4.

Toner, in an amount corresponding to the amount consumed by image forming, is supplied from the hopper 31 to the developer container 20 through the developer supplying port 30, by the rotational force of the supplying screw 32 and the weight of the developer. Thus, the supplying developer is supplied into the developing device 4 from the hopper 31.

The supplying method employs a known block supplying system in which any desired amount of toner is not supplied as appropriate, but a supplying amount of a single block (300 mg in the present exemplary embodiment) set in advance is supplied each time by a single rotation of the supplying screw 32. When the phase of the supplying screw 32 is variable within a single rotation cycle, the toner supplying amount fluctuates. Thus, the block supplying system in which the toner is supplied in unit of a rotation cycle is preferably employed to achieve a stable supplied amount.

<Method of Determining Amount of Toner to be Supplied>

A method of determining an amount of toner to be supplied into the developing device 4 is described.

In the first exemplary embodiment, an amount F of toner supplied by the supplying device 31 is determined by F=F(Vc)+F(In), where F(Vc) is a toner consumption amount predicted from the video count, and F(In) is a toner consumption amount obtained by toner density information detected by the inductance sensor 35. The video count and the detection result of the inductance sensor 35 are information on a toner consumption amount.

A basic concept of how the supplied amount is determined is as follows. A feedforward operation of determining the toner consumption amount predicted from the video count is performed, and then a feedback operation of offsetting a difference from a target toner density in the developing device 4 is performed. The supplied toner amount F can be determined with the information from the inductance sensor 35 alone. However, this might lead to a delay in the supplying control due to lagging of the time at which the supplied toner reaches the inductance sensor 35 after the toner is actually supplied. Thus, the present exemplary embodiment employs a system, preferable for improving toner supply accuracy, in which the toner consumption amount is roughly determined based on the video count, and then the toner consumption amount is corrected based on the inductance information.

<Calculation of Supply Amount Based on Video Count>

As described above with reference to FIG. 3, the video signal count unit 207 calculates video counts V(Y), V(M), V(C), and V(K) for each printed sheet. In the present exemplary embodiment, the video count of a completely solid image (image with a coverage rate of 100%) on a single side of an A4 size sheet of one of the colors is 512. The video count represents coverage rate information on a single printed sheet, and can be used to estimate a toner consumption amount per sheet. For example, when the video count of 512 is output in the present exemplary embodiment, because the toner amount per unit area is 0.5 mg/cm$^2$, the consumption amount is calculated as 312 mg=0.5 mg×A4 size. The video count and the toner consumption amount F(Vc) are set to be in a proportional relationship. For example, when the video count is 256, F(Vc) of 156 mg=312 mg×256/512 is calculated.

<Calculation of Supply Amount Based on Inductance Information>

How the toner consumption amount F(In) is determined based on the inductance information is described in detail. The two-component developer includes magnetic carrier and nonmagnetic toner as main components. Thus, as the toner density (a ratio of toner particle weight to the total weight of the carrier and toner particles) of the developer changes, apparent magnetic permeability, based on a mixture ratio between the magnetic carrier and the nonmagnetic toner, changes. The resultant detected output (Vsig) changes substantially linearly in accordance with the toner density (T/D ratio). Thus, the detection output of the inductance sensor 35 depends on the toner density of the two-component developer in the developing device 4.

More specifically, a higher toner density, indicating a higher percentage of nonmagnetic toner in the developer, leads to a lower apparent magnetic permeability of the developer, and thus a lower detection output is obtained. On the other hand, a lower toner density leads to a higher apparent magnetic permeability of the developer, and thus a higher detection output is obtained. The toner density of the developer can be detected by using the inductance sensor 35 in the manner described above. Then, the detected Vsig is compared with an initial reference signal Vref, and the toner supply amount F(In) of the toner supplying unit is determined based on a result of calculating the difference (Vsig−Vref) therebetween. The initial reference signal Vref is an output value corresponding to an initial state of the developer, that is, an initial toner density, and control is performed to offset the difference between Vsig and the initial reference signal Vref. For example, when Vsig−Vref>0, it means that the toner density of the developer is lower than a target toner density, and thus a toner supply amount required in accordance with the difference is determined. Thus, a larger difference between Vsig and Vref corresponds to a larger toner supply amount. When Vsig−Vref≤0, it means that the toner density is higher than the target toner density, and thus the toner consumption amount F(In) of a negative value is calculated.

<Method of Controlling Toner Refresh>

A method of controlling a toner refresh (toner discharge) operation, as a feature of the present invention, is described in detail below, but first of all, the above-described mechanism of toner deterioration by image forming is described again in detail.

In the image forming apparatus having the configuration described above, when a low coverage rate image is formed, only a small portion of the toner in the developer container 20 is transferred to the photosensitive drum 1. Thus, the toner in the developer container 20 is stirred by the first and the second conveyance screws 22*a* and 22*b* and rubbed when passing through the regulating blade 25, for a long period of time. As a result, the external additive on the toner described above is separated or embedded in the toner surface whereby degradation of the flowability and chargeability of the toner that leads to image quality degradation occurs. What is important in this mechanism is that the toner deterioration proceeds in proportion to a time period during which the toner stays in the developing device 4. Thus, the toner deterioration can be reduced by shortening the staying time. Thus, in one conventionally proposed method, a downtime is set during which the deteriorated toner in the developing device 4 is forcibly discharged (consumed) by being developed (transferred) on a non-image region on the photosensitive drum 1. In this process, the downtime, during which the toner discharge operation is performed, and toner discharge frequency are changed in accordance with a coverage rate, based on the fact that how fast the toner deterioration proceeds depends on the coverage rate (toner degradation proceeds faster with a lower coverage rate). The coverage rate is a rate of a toner area in a maximum image formation area, and is 100% in a black solid image and is 0% in a blank image.

Figure 10:
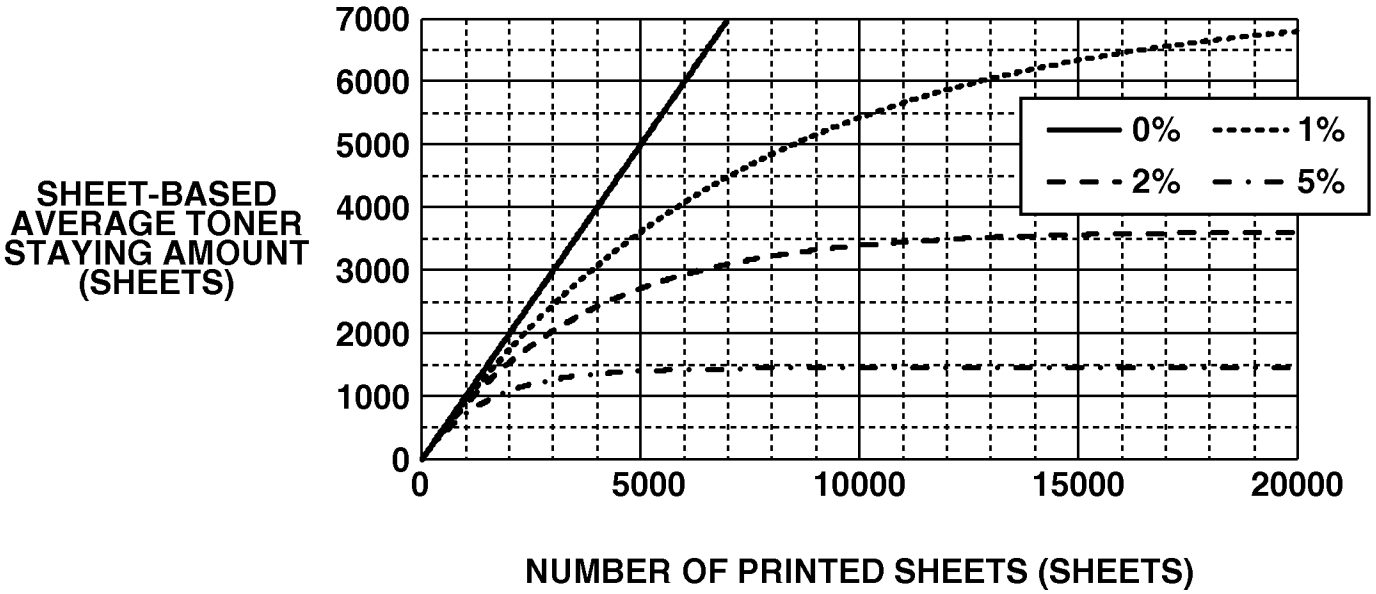
FIG. 10 is a diagram illustrating relationship between the number of printed sheet and the sheet-based average toner staying amount in image printings with various coverage rates according to the first exemplary embodiment.

How the toner staying time in the developing device 4 changes and the toner deterioration proceeds in image forming with different coverage rates is described with reference to FIG. 10. FIG. 10 illustrates relationship between a sheet-based average toner staying amount in the developing device 4 and the number of printed sheet in the image forming with different coverage rates. The sheet-based average toner staying amount indicates an average amount of toner staying in the developing device 4 counted in the number of sheets.

The solid line in FIG. 10 indicates the sheet-based average toner staying amount with respect to the number of printed sheets in the image forming with a coverage rate of 0%. When the coverage rate is 0%, no toner is consumed. Thus, when the number of printed sheets is incremented by 1, all the toner in the developing device 4 stays in the developing device 4 in an amount corresponding to a single sheet, and thus the sheet-based average toner staying amount is also incremented by 1. A dotted line in FIG. 10 indicates the sheet-based average toner staying amount with respect to the number of printed sheets when an image with a coverage rate of 1% is formed. Here, the toner is consumed by a coverage rate of 1% unlike in the case of the coverage rate of 0%, and thus the amount of toner corresponding to the coverage rate of 1% is exchanged with supplied toner, that is, new toner. Thus, every time the number of printed sheets is incremented by 1, the sheet-based average toner staying amount is incremented by an amount that is slightly smaller than that for a single sheet due to the amount exchanged with the new toner. Thus, the sheet-based average toner staying amount becomes closer to a saturated amount as the number of printed sheets increases. A dashed line in FIG. 10 indicates the sheet-based average toner staying amount with respect to the number of printed sheets in a case where an image with a coverage rate of 2% is formed. Here, the amount of toner exchanged with new toner corresponds to the coverage rate of 2% and thus is two times as large as that in the case of the coverage rate of 1%. Thus, the increment rate of the sheet-based average toner staying amount is further reduced, and the saturated sheet-based average toner staying amount is reduced. Similarly, a dotted-dashed line indicates a case where the image forming is performed with a coverage rate of 5%. Here, the increment rate is even further reduced, and the saturated sheet-based average toner staying amount is further reduced. The saturated sheet-based average toner staying amount is in inverse proportion to the average coverage rate, and is about 7200, 3600, and 1450 respectively when the coverage rate is 1%, 2%, and 5%, under the condition of the present exemplary embodiment.

How the sheet-based average toner staying amount described above is in proportion to the toner deterioration rate will be described. As described above, when the toner is stirred and rubbed for a long period of time, toner deterioration occurs in the developing device 4, and the external additive on the toner particles is separated or embedded, so that the toner flowability and chargeability are changed. The state change of the external additive can be quantitatively recognized by using a Brunaure Emett Teller (BET) value. In the present exemplary embodiment, the BET value of the toner is measured by using quadra sorb SI manufactured by Quantachrome Corporation. The BET value of the toner, used to recognize a change in an attached state of the external additive on the toner surface, indicates the amount of the external additive attached on the toner surface. A smaller amount of the external additive on the toner surface corresponds to a lower BET value. Thus, a larger BET value of toner is obtained when the external additive with a large BET value is externally added to base toner, and the BET value of the toner is reduced when the external additive is embedded into the toner resin in the external additive or separated from the toner surface. When the external additive is completely eliminated from the toner surface, the BET value of the toner becomes equal to that of the base toner.

Figure 7:
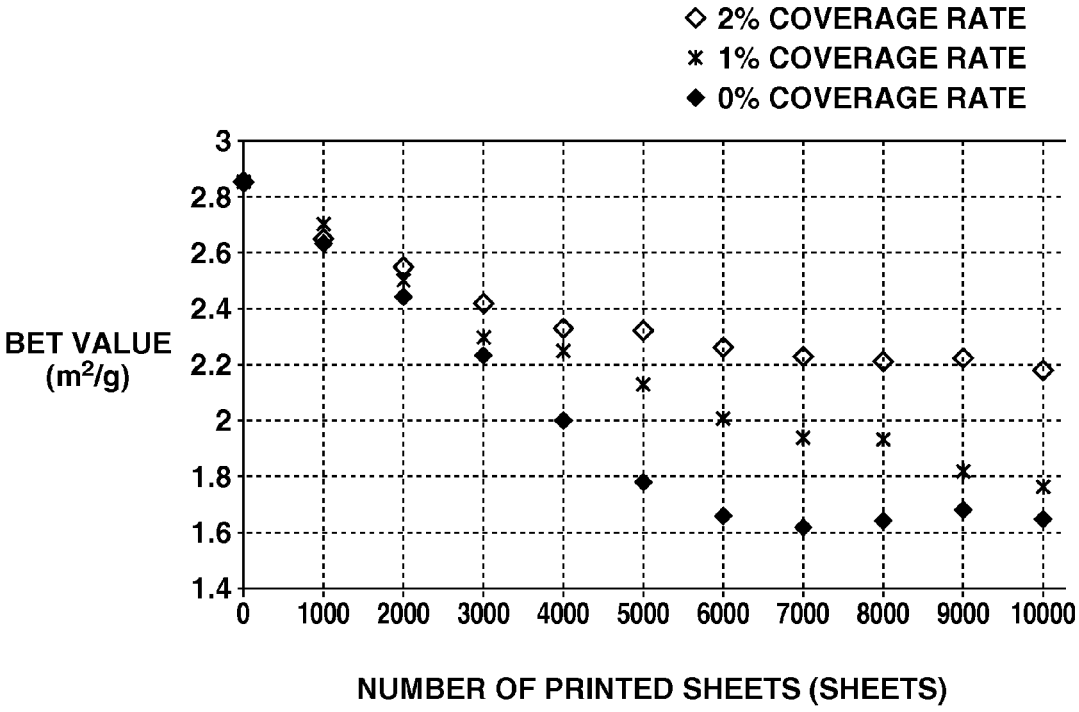
FIG. 7 is a diagram illustrating relationship between the number of printed sheets and a toner Brunaure Emett Teller (BET) value according to the first exemplary embodiment.
Figure 8:
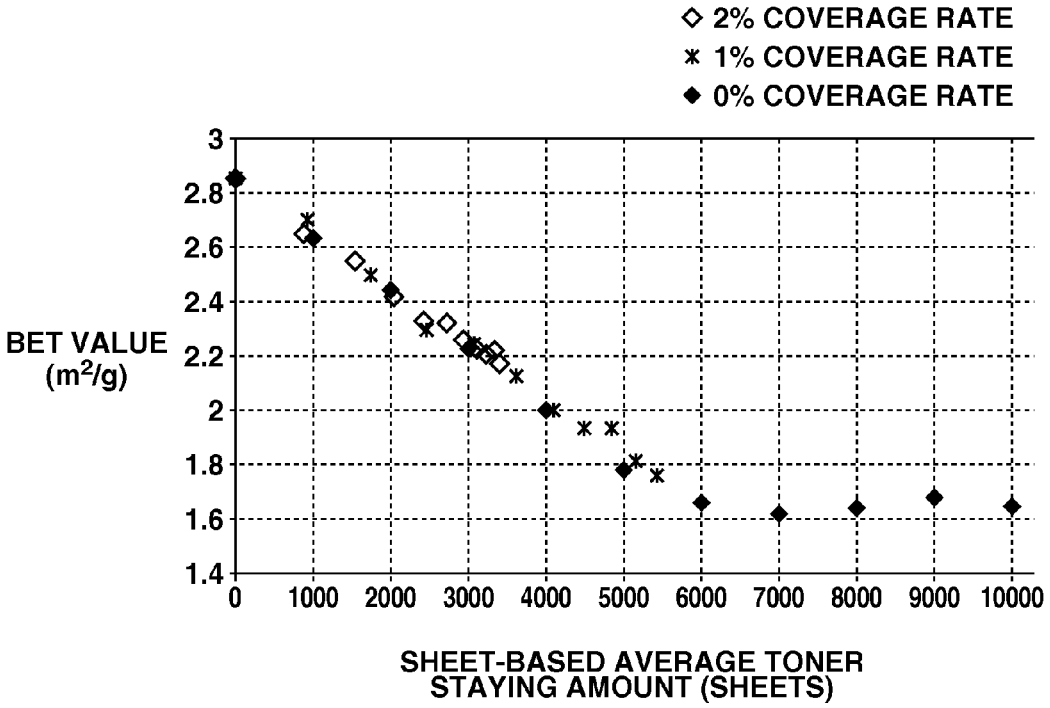
FIG. 8 is a diagram illustrating relationship between a sheet-based average toner staying amount and the toner BET value according to the first exemplary embodiment.

The developer is sampled every time of when image forming is performed on 1000 sheets, with the coverage rates of 0%, 1%, and 2% under an environment of 30° C. FIGS. 7 and 8 are graphs in which the BET value, as an index of the toner deterioration level, is plotted respectively with respect to the number of printed sheets and the sheet-based average toner staying amount. It can be seen in FIG. 7 that the BET value decreases as the number of printed sheets increases, and that the BET value is more largely decreased when an image with a lower coverage rate is formed. The BET value does not drop below a value around 1.6 $m^2/g$. This indicates that the external additive is substantially eliminated at the point where the 1.6 $m^2/g$ is reached, and thus the BET value 1.6 $m^2/g$ is equivalent to the BET value of the base toner as described above. FIG. 8 is a graph obtained by replacing the number of printed sheets on the horizontal axis in FIG. 7 with the sheet-based average toner staying amount. FIG. 8 indicates that the sheet-based average toner staying amount changes at the same rate as the BET value change regardless of whether the coverage rate of the formed image is 0%, 1%, or 2%. This means that the toner deterioration level (the BET value in the present exemplary embodiment) can be uniquely recognized with the sheet-based average toner staying amount.

In the present exemplary embodiment, toner scattering, fogging, and grainy effect notably occur when the BET value, indicating the toner deterioration level, is reduced to or below 2.0 $m^2/g$. Thus, as illustrated in FIG. 8, a sheet-based average toner staying amount of 4000 sheets, corresponding to a BET value of 2.0 $m^2/g$, is a threshold of the occurrence of the problems. For example, when the images with the coverage rate of 2% or higher are formed, the saturated sheet-based average toner staying amount is 3600 sheets as illustrated in FIG. 10. Thus, the problems described above do not occur even when the images with the coverage rate described above are formed for a long period of time. When the coverage rate is 1%, the problems described above occur at or around a point where the number of printed sheets exceeds 6000. Thus, in the present exemplary embodiment, fogging and grainy effect at a notable level does not occur when images with the coverage rate of 2% or higher are successively formed. As described above, the toner deteriorates by staying in the developing device 4 for a long period of time while the images with a low coverage rate are formed. All things considered, the toner refresh control should be executed in such a manner that the sheet-based average toner staying amount does not increase to or above a predetermined number of sheets. Thus, to prevent the toner deterioration, the coverage rate of 2% is set as the threshold, and when images with the coverage rate equal to or lower than 2% are formed, the refreshing should be performed in such a manner that the toner in an amount corresponding to the difference from the coverage rate of 2% is consumed and then supplied.

As described in the opening section of this specification, there is also an issue of a large image density fluctuation occurring when images with a low coverage rate are formed for a while and the toner charging amount is largely increased. Then, if an image with a high coverage rate is formed, sharp reduction of the toner charging amount occurs due to toner supplying.

FIG. 14 illustrates toner charging amounts in the developing device 4 obtained by forming images on 1000 sheets with coverage rates of 1%, 2%, 5%, 10%, and 20%. For example, when images with the coverage rate of 2% are successively formed, the toner charging amount is 47 μC/g that is different in the Δ charging amount by 10 μC/g from the toner charging amount of 37 μC/g, obtained when images with the coverage rate of 20% are successively formed. This means that the toner charging amount has changed by about 25% of an absolute value 40 μC/g of the toner charging amount.

When the images are formed under a constant development contrast potential, the change of the image density is in inverse proportion to the change of the toner charging amount. Thus, the image density is also changed by approximately 25%. Assuming that a general acceptable limit value of tint variation is $\Delta E<5$, the allowable change of the density is approximately 15 to 20%. Thus, the toner charging amount change of 25% described above is unacceptable. The density change is regulated by performing known patch image control for a development contrast potential. However, when the toner charging amount largely changes, the image control in which the toner density change is detected and feedback is performed leads to a large difference between densities before and after the control, and thus is unfavorable. Therefore, the toner charging amount change is preferably regulated to be smaller than a predetermined amount. In the present exemplary embodiment, the target toner charging amount change is within 15% of the center toner charging amount 40 μC/g, that is, within Δ6 μC/g. As illustrated in FIG. 14, the toner charging amount of 43 μC/g is obtained when the image with the coverage rate of 5% is successively formed on 1000 sheets, and the toner charging amount of 37 μC/g is obtained when the image with the coverage rate of 20% or higher is successively formed on 1000 sheets. The difference between the charging amounts is 6 μC/g, and thus the density change is successfully regulated to be within the allowable range. All things considered, to regulate the toner charging amount change, the coverage rate of 5% is set as a threshold, and when the image with the coverage rate equal to or lower than 5% is formed, the refreshing may be performed in such a manner that the toner in an amount corresponding to the difference from the coverage rate of 5% is consumed and then supplied.

As described above, the toner refresh control is preferably performed with the coverage rate of 2% set as the threshold to prevent the image failure, such as fogging and grainy effects, due to toner deterioration. To regulate the tint variation, due to the toner charging amount change caused by the switching from the low coverage rate image forming to the high coverage rate image forming, to be within the allowable range, the toner refresh control may be performed with the coverage rate of 5% set as the threshold. The toner refresh control needs to be performed with the coverage rate of 5% set as the threshold to achieve both prevention of image failure and regulation of tint variation. However, in such a case, refreshing is excessively performed for preventing the image failure. In the present exemplary embodiment, as described below, control is performed as described in detail below in such a manner that a threshold for executing the toner refreshing is set to an optimum value to prevent the toner from being discharged more than necessary.

A method for controlling a toner forcibly consuming operation and operation conditions are described. The basic concept of toner forcible consumption and the control method is the same among the colors. Thus, description on colors is omitted in some cases in the flowcharts referred to in the following description, and this means that control common to the colors is performed. In the present exemplary embodiment, the following model case is described as an easily understandable example. In the model case, an image (hereinafter, referred to as "black low duty image chart") with coverage rates of Y=3%, M=3%, C=5%, and K=1.0% of the respective YMCK colors per printed image is successively formed on A4 size sheets.

<Toner Refresh Control (1) for Preventing Image Failure When Low Coverage Image is Successively Formed>

Figure 9:
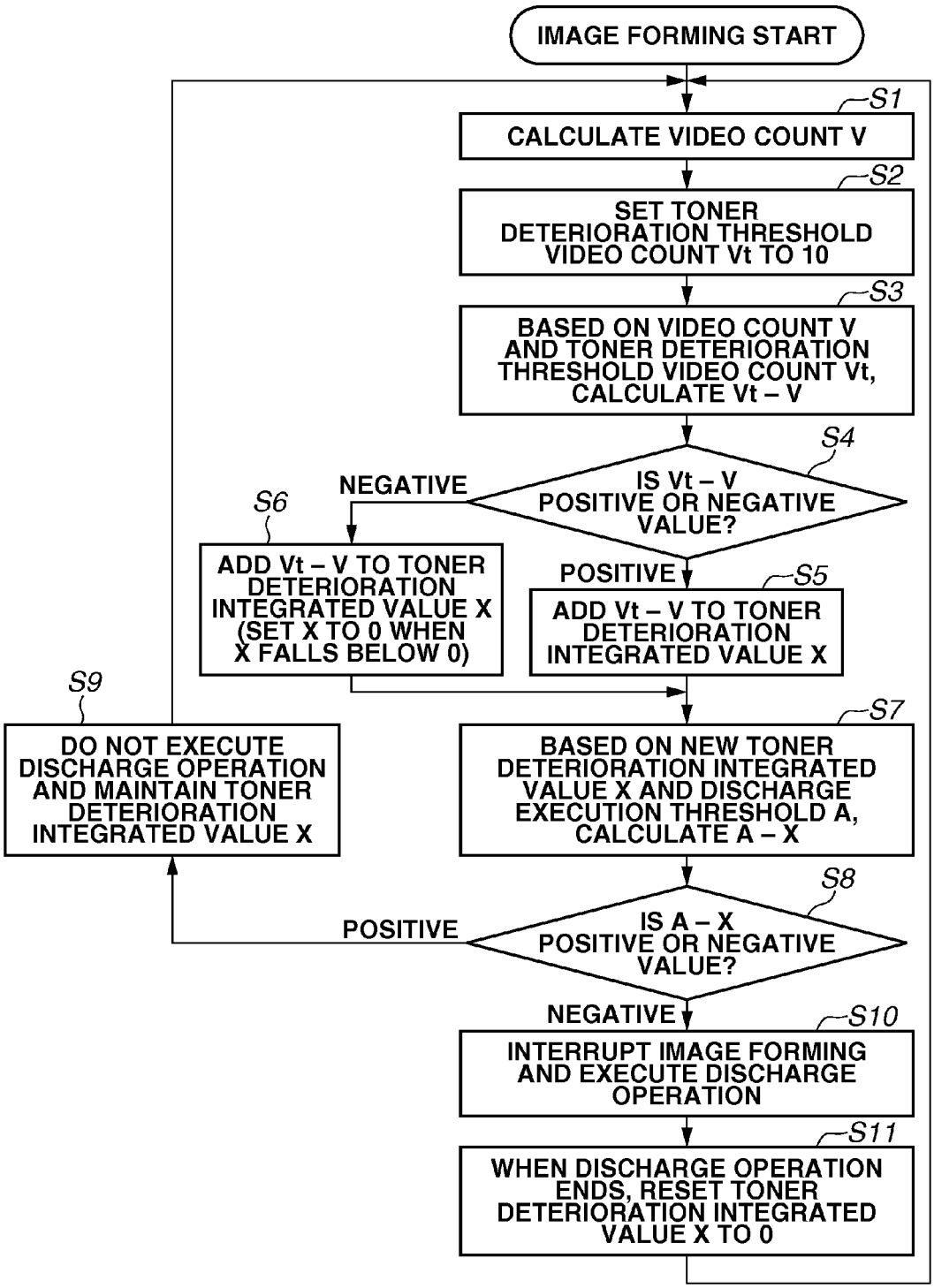
FIG. 9 is a flowchart illustrating toner refresh control (1) in the image forming apparatus according to the first exemplary embodiment.

Toner refresh control (1) for preventing the image failure when low coverage images are successively formed will be described with reference to a flowchart illustrated in FIG. 9.

When image forming starts, in step S1, the video signal count unit 207 calculates video counts V(Y), V(M), V(C), and V(K) of the respective colors in each printed sheet as described above with reference to FIG. 3. In the present exemplary embodiment, the video count of the entirely solid image (image with the coverage rate of 100%) with one color on one side of an A4 size sheet is 512. Thus, the video counts of the "black low duty image chart" are V(Y)=15, V(M)=15, V(C)=26, and V(K)=5. Here, the video count is calculated by rounding off the numbers after the decimal point.

Then, in step S2, a toner deterioration threshold video count Vt is set. The toner deterioration threshold video count Vt is a video count corresponding to the minimum toner consumption amount required for preventing the image quality degradation due to the toner deterioration. In the present exemplary embodiment, Vt is switched to 10 for preventing the image failure, such as fogging and flowability degradation, and to 26 for regulating the tint variation occurring when the low coverage rate image forming is switched to the high coverage rate image forming.

Referring back to FIG. 9, in step S3, Vt−V which is a difference between the video count V and the toner deterioration threshold video count Vt is calculated. In step S4, whether Vt−V is a positive value or a negative value is determined. More specifically, the toner refresh control is executed based on comparison information (first information) as a difference between a first toner deterioration threshold video count Vt (=10) as a first threshold and the video count V as information related to a toner consumption amount. When Vt−V is a positive value (POSITIVE in step S4), it means that the toner deterioration proceeds due to the low coverage rate, and the processing proceeds to step S5. In step S5, (Vt−V) is added to a first toner deterioration integrated value X (first integrated information). On the other hand, when Vt−V is a negative value (NEGATIVE in step S4), it means that an image with a high coverage rate is printed and thus the toner deterioration state is recovered by the toner exchange, the processing proceeds to step S6. In step S6, the (Vt−V) as a negative value is added to the first toner deterioration integrated value X in consideration of the recovered amount. When the calculation is simply performed, the toner deterioration integrated value X might be reduced below 0. In such a case, the first toner deterioration integrated value X is set to 0 because a quality higher than that in an initial state cannot be achieved even when the images with a high coverage rate are successively printed and thus the toner is frequently exchanged.

Then, in step S7, a difference (A−X) between the first toner deterioration integrated value X, calculated and updated in step S5 or step S6 every time image forming is performed, and a first discharge executing threshold A (first predetermined value) is calculated. The first discharge executing threshold A is any predetermined settable value. When the discharge executing threshold A is small, the toner discharge operation is frequently performed regardless of the coverage rate of the image to be successively formed. The first discharge executing threshold A is set to 512 in the present exemplary embodiment. If the first discharge executing threshold A is set to be too high, a period of time during which the toner deterioration proceeds becomes long before the toner discharge operation is executed, and thus is not preferable because a binary distribution of the new toner and the deteriorated toner is likely to be formed in the developing device 4. The toner refresh control does not recover the deteriorated toner itself, but instead consumes the deteriorated toner at a certain frequency and supplies new toner so that average toner deterioration is reduced. Thus, the control is preferably executed at an interval (frequency) with which the toner deterioration in the developer is prevented from largely fluctuating. For example, in a case where an image with the coverage rate of 0% is formed, that is, where the toner consumption is small and thus the toner deterioration most quickly proceeds, the toner refreshing is performed every time at least 50 A4 sheets are printed. In view of this, the first toner discharge executing threshold for executing the toner refreshing is set to 512.

Then, in step S8, whether the difference (A−X) between the first toner deterioration integrated value X, calculated in step S7, and the first discharge executing threshold A is a positive value or a negative value is determined. When the difference (A−X) is a positive value (POSITIVE in step S8), it is determined that the toner deterioration has not proceeded to a level at which the toner discharging is immediately required, and the processing proceeds to step S9. Then, in step S9, the image forming is continuously executed. On the other hand, when the difference (A−X) is a negative value (NEGATIVE in step S8), it is determined that the toner deterioration has proceeded to such a level that the toner discharging needs to be immediately executed, and thus the processing proceeds to step S10. In step S10, the image forming is interrupted to execute the toner discharge operation. After the toner discharge operation ends, in step S11, the first toner deterioration integrated value X is reset to 0.

Figure 11:
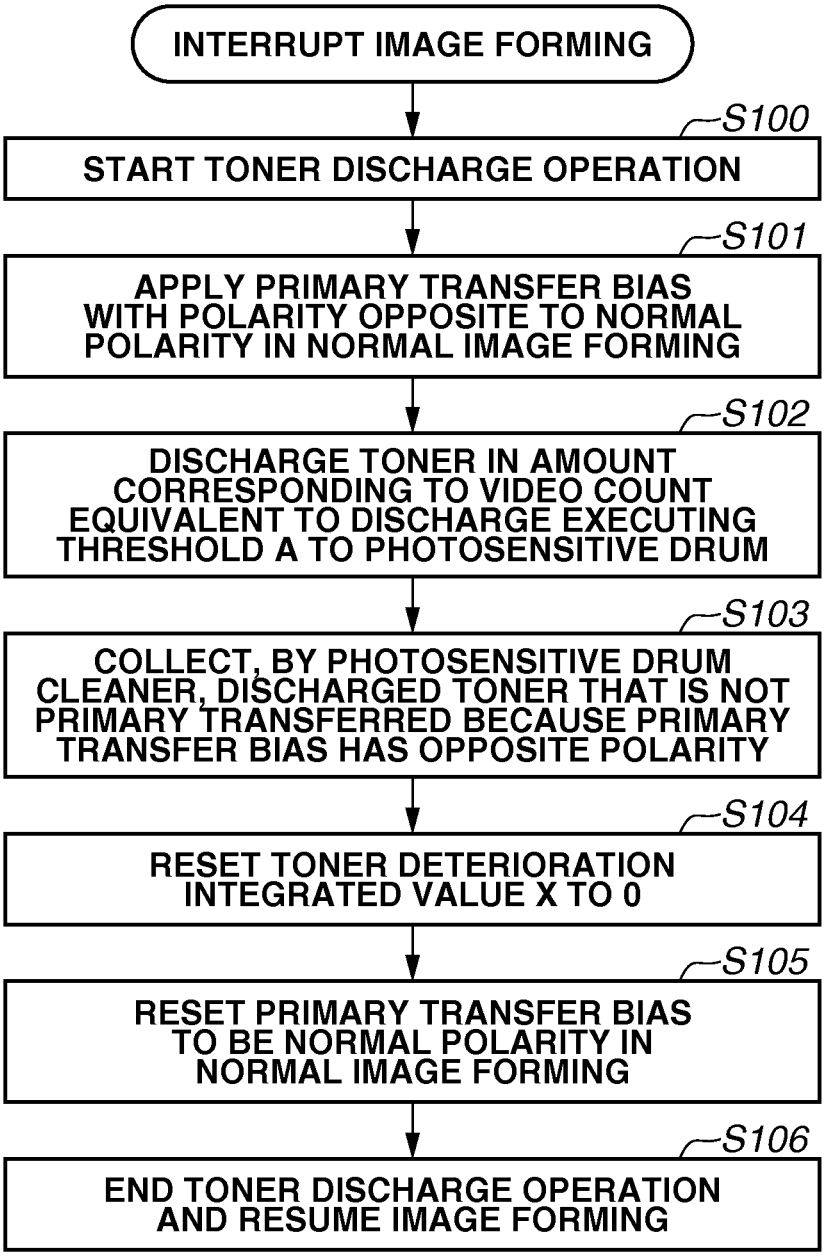
FIG. 11 is a flowchart illustrating processing executed in the image forming apparatus according to the first exemplary embodiment under toner discharge control.

The toner discharge operation is described with reference to FIG. 11. When it is determined in step S8 that the difference (A−X) is a negative value, in step S100 in FIG. 11, the printer controller unit 209 as a control unit interrupts the image forming and executes the toner discharge operation. In step S101, a primary transfer bias is applied with a polarity opposite to that in a normal image forming (that is, a transfer bias with a polarity that is the same as that of the toner image on the photosensitive drum 1). Then, in step S102, the toner in an amount corresponding to the video count equivalent to the first discharge executing threshold A is discharged, and the toner in an amount corresponding to the discharged amount is supplied. During the discharge operation (forcibly consuming operation), control is preferably performed in such a manner that the development sleeve 24 rotates at least for a single time. The latent image, on the photosensitive drum 1, used for the toner discharge operation is preferably a solid image with respect to the longitudinal direction of the photosensitive drum 1, so that the shortest possible downtime, during which the discharging is performed, is achieved. The toner discharged onto the photosensitive drum 1 is set to have a transfer bias with which the toner is not transferred onto the intermediate transfer belt 121. Thus, in step S103, the discharged toner is collected by a photosensitive drum cleaner 9. Then, in step S104, the first toner deterioration integrated value X is reset to 0 in step S104. In step S105, as final processing, the primary transfer bias is reset to be the polarity in the normal image forming, and in step S106, the toner discharge operation is terminated, so that the normal image forming operation is resumed.

Figure 19:
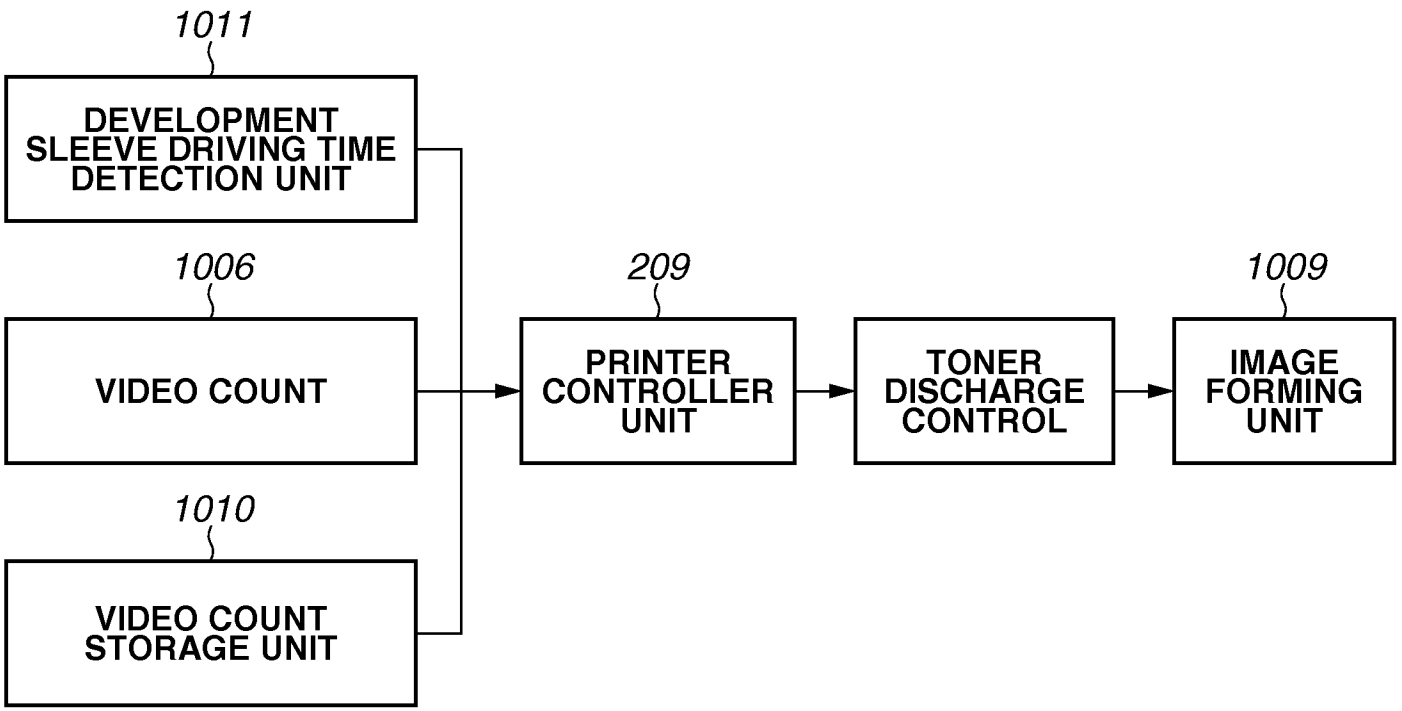
FIG. 19 is a block diagram illustrating a control block configuration example of a toner discharge operation in the image forming apparatus.

As illustrated in a FIG. 19 as a simple control block diagram, a result of a video count 1006 and information from a video count storage unit 1010 are transmitted to the printer controller unit 209 as a control unit. The printer controller unit 209 instructs an image forming unit 1009 to execute the toner discharge operation in accordance with the toner discharge control illustrated in the flowcharts in FIGS. 9 and 11. The toner refresh control for preventing the image failure when the low coverage rate image is successively formed is as described above.

<Toner Refresh Control (2) for Regulating Tint Variation When Low Coverage Image Forming is Switched To High Coverage Image Forming>

Figure 15:
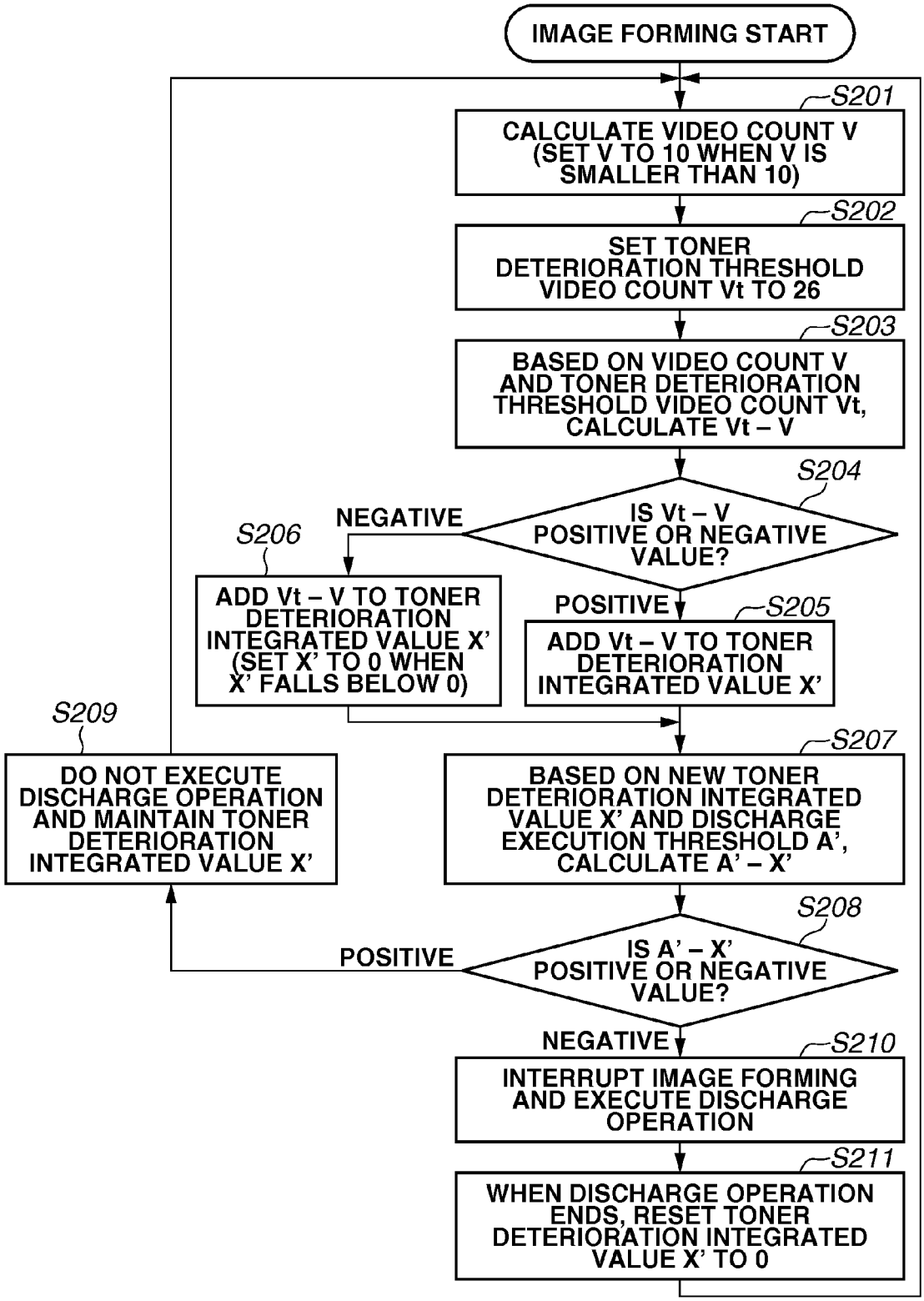
FIG. 15 is a flowchart illustrating toner refresh control (2) in the image forming apparatus according to the first exemplary embodiment.

This toner refresh control is described with reference to a flowchart in FIG. 15. The basic control flow is the same as that in the toner refresh control (1). In step S201, the video signal count unit 207 calculates video counts V(Y), V(M), V(C), and V(K) of the respective colors in each printed sheet. As to be described below, in a case where the video count V is smaller than 10, the video signal count unit 207 sets the video count V to 10. As described above, to regulate the tint variation to be within the allowable value, the toner refresh control needs to be executed with the threshold as the coverage rate of 5%. Thus, in step S202, the toner deterioration threshold video count Vt is set to a second toner deterioration threshold Vt=26 (5% is 26 when 512 is 100%).

The discharge executing threshold A, which is set to the first discharge executing threshold A=512 in the toner refresh control (1), is set to a second discharge executing threshold A'=8000 (second predetermined value). More specifically, for example, when the image with the coverage rate of 2% is successively formed, increase of Vt(26)−V(10)=16 is obtained each time the image is formed on a single sheet, and thus the toner refresh control is executed every time the image is formed on 500 sheets. Thus, the toner refresh control is executed based on comparison information (second information) representing a difference between the second toner deterioration threshold video count Vt (=26) as a second threshold and the video count V as information related to a toner consumption amount. The toner in an amount corresponding to the video count equivalent to the second discharge executing threshold A' is discharged onto the photosensitive drum 1. Thus, the toner amount corresponding to an amount consumed when a solid image is formed on approximately 15 A4 sheets is consumed and supplied.

A method of setting the executing threshold A' according to the present exemplary embodiment will be described. In the present exemplary embodiment, the difference between a case, where the coverage rate is 2% and the toner charging amount is the highest, and a case, where the coverage rate is 20% and the toner charging amount is the lowest, in the toner charging amount is set to be not higher than ΔE<5. Thus, the toner discharge amount is set to be within approximately Δ6 μC/g from the center value. In the present exemplary embodiment, the toner charge amount is 43.5 μC/g when the image with the coverage rate of 2% is successively formed on 500 sheets, and is 37 μC/g when the image with the coverage rate of 20% is successively formed on 500 sheets. Thus, even when the image with the coverage rate of 2%, with the toner charging amount with the largest offset amount, are successively output, the refresh operation is surely executed every time 500 sheets are printed, by setting the executing threshold A' to 8000. Therefore, ΔE<5 may be set. The executing threshold A' is not limited to 8000 as in the present exemplary embodiment, and may be appropriately set to any value in accordance with an acceptable level of the tint variation. In the present exemplary embodiment, the upper limit of the executing threshold A' is set to 16000.

In the present exemplary embodiment, the toner deterioration threshold Vt is larger in the toner refresh control (2) than in the toner refresh control (1). In the present exemplary embodiment, the second toner discharge executing threshold A' is larger than the first toner discharge executing threshold A. The amount of toner discharged (transferred) in a single discharge operation is set to be larger in the toner refresh control (2) than in the toner refresh control (1). With such a configuration, the toner discharge control can be appropriately executed for regulating each of the toner deterioration and the density change. Therefore, refresh control is performed in such a manner that the downtime is prevented from being excessively long and the refreshing is prevented from being excessively or insufficiently performed.

A reason why the discharge threshold A' (=8000) can be set to be larger than A (=512) in the toner refresh control (1) is described. As described above, the tint variation is caused by the difference in the toner charging amount between the low coverage rate image forming and the high coverage rate image forming. The toner charging amount is likely to be averaged through charge delivering and receiving in the toner in the developing device 4. Thus, by setting the discharge threshold A' to a large value, the charging amount is less likely to fluctuate in the developing device. For example, in a case where an image with a high coverage rate is printed immediately after an image with a low coverage rate of 5% or lower is printed on a small number of sheets, such as 100 sheets, when the frequency indicated by the executing threshold is too low, the toner might be discharged more than necessary even though the average coverage rate exceeds 5%. This can be prevented by increasing the frequency indicated by the executing threshold. In the toner refresh control (1), the toner refresh has already been performed in such a manner that the toner discharge control is performed while regarding an image with a coverage rate lower than 2% as an image corresponding to the coverage rate of 2%. Thus, also in the toner refresh control (2), control calculation is performed while regarding all images with a coverage rate lower than 2% as images corresponding to the coverage rate of 2%. More specifically, in step S201, in a case where the video count V is smaller than 10, the video signal count unit 207 sets the video count V to 10.

Then, in step S203, Vt−V, which is the difference between the video count V and the second toner deterioration threshold video count Vt, is calculated. In step S204, whether Vt−V is a positive or negative value is determined. When Vt−V is a positive value (POSITIVE in step S204), it means that the toner charging amount is largely offset from the center value due to the low coverage rate, and processing proceeds to step S205. In step S205, (Vt−V) is added to the second toner deterioration integrated value X' (second integrated information). On the other hand, when Vt−V is a negative value (NEGATIVE in step S204), it means that an image with a high coverage rate is printed and thus the toner deterioration state is recovered by the toner exchange, and the processing is proceeds to step S206. In step S206, a negative value is added to the second toner deterioration integrated value X' in consideration of the recovered amount. When the calculation is simply performed, the second toner deterioration integrated value X' might be reduced below 0. In such a case, the toner deterioration integrated value X' is set to 0 because a quality higher than that in an initial state cannot be achieved even when the image with a high coverage rate is successively printed and thus the toner is frequently exchanged. Then, in step S207, a difference (A'−X') between the second toner deterioration integrated value X' calculated and updated in step S205 or step S206 every time image forming is performed, and the second discharge executing threshold A' is calculated.

Then, in step S208, whether the difference (A'−X') between the toner deterioration integrated value X' calculated in step S207 and the discharge executing threshold A' is a positive or negative value is determined. When the difference (A'−X') is a positive value (POSITIVE in step S208), it is determined that the toner deterioration has not proceeded to a level at which the toner discharging is immediately required, and the processing proceeds to step S209. In step S209, the image forming is continuously executed. On the other hand, when the difference (A'−X') is a negative value (NEGATIVE in step S208), it is determined that the toner deterioration has proceeded to such a level that the toner discharging needs to be immediately executed, and the processing proceeds to step S210. In step S210, the image forming is interrupted to execute the toner discharge operation. After the toner discharge operation ends, in step S211, the second toner deterioration integrated value X' is reset to 0.

A specific case is considered where an image of the "black low duty image chart" is successively formed on 1000 sheets with the toner discharge control method described above.

A description is given on the toner refresh control (1) with reference to FIG. 12. A table in FIG. 12 illustrates how the toner deterioration integrated value X is calculated for each color in the toner discharge control according to the present exemplary embodiment when the image of the "black low duty image chart" is formed on a single sheet. As illustrated in the table in FIG. 12, when the image of the "black low duty image chart" is formed, the toner deterioration integrated value X is 0 for all yellow (Y), magenta (M), and cyan (C) because of a sufficiently high coverage rate.

On the other hand, the first toner deterioration integrated value X per sheet for black (K) is +5. It is because the coverage rate is 1.0% and the video count V(k) is 5 which is lower than the toner deterioration threshold video count Vt=10. Thus, the toner discharge operation is executed each time 102 sheets are printed because the first discharge executing threshold A is 512 and thus 512/5=102 (numbers after the decimal point is rounded down).

A description is given on the toner refresh control (2) with reference to FIG. 13. A table in FIG. 13 illustrates how the second toner deterioration integrated value X' is calculated for each color in the toner discharge control according to the present exemplary embodiment when the image of the "black low duty image chart" is formed on a single sheet. As illustrated in the table in FIG. 13, when the image of the "black low duty image chart" is formed, the video counts corresponding to Y and M, of which coverage rate is 3.0%, are 15. Thus, the difference Vt−V from the second toner deterioration threshold video count Vt=26 is 26−15=+11. Thus, the second toner deterioration integrated value X' per printed sheet is +11. The video count corresponding to C, of which coverage rate is 5.0%, is 26. Thus, the difference from the second toner deterioration threshold video count Vt=26 is Vt−V=0, whereby the second toner deterioration integrated value X' per printed sheet is 0. The coverage rate of K is 1.0% but is regarded as 2.0% when the image with the coverage rate lower than 2% has been formed under the toner refresh control (1) and thus the difference has already been offset by refreshing. Thus, the video count corresponding to the coverage rate of 2% is 10, and thus the second toner deterioration integrated value X' per sheet is +16, as the difference between the video count and the second toner deterioration threshold video count Vt=26. Therefore, the discharge operation is executed when 8000/16=500 sheets are printed because the second discharge executing threshold A' for K is 8000.

As described above, in the present exemplary embodiment, the toner refresh control can be executed at an appropriate frequency corresponding to the toner deterioration level and the state of the toner charging amount so as not to be excessive or insufficient. Thus, an image forming apparatus that can prevent the image failure, such as fogging and grainy effect, and regulate tint variation to be within an acceptable range can be provided.

As a use case, only images with a low coverage rate of 5% or lower, such as images normally used in offices, may be output. Some users might prefer productivity over image quality. In such cases the toner refresh control (2) needs not to be executed. Thus, it is a matter of course that a mode in which the toner refresh control (2) can be turned ON and OFF may be employed. The toner refresh control (2) is performed to regulate density variation when the high coverage rate image forming is performed after the low coverage rate image forming is successively performed, and thus needs not to be executed when no high coverage rate image forming is performed. Thus, a first mode in which the toner refresh control (1) and the toner refresh control (2) can both be executed and a second mode in which only the toner refresh control (1) can be executed may each be selectively executed. For example, a user may set a desired one of the modes through an operation unit.

In the present exemplary embodiment described above, the toner refresh control (1) and the toner refresh control (2) are respectively executed with the toner deterioration threshold video counts Vt=10 and 26. Alternatively, the toner deterioration threshold video count Vt may be set to 10 in both cases, and the detected video count V in the toner refresh control (2) may be negatively offset (calculated) by 16 so that the difference Vt−V would be the same and the same effect can be obtained.

Figure 17:
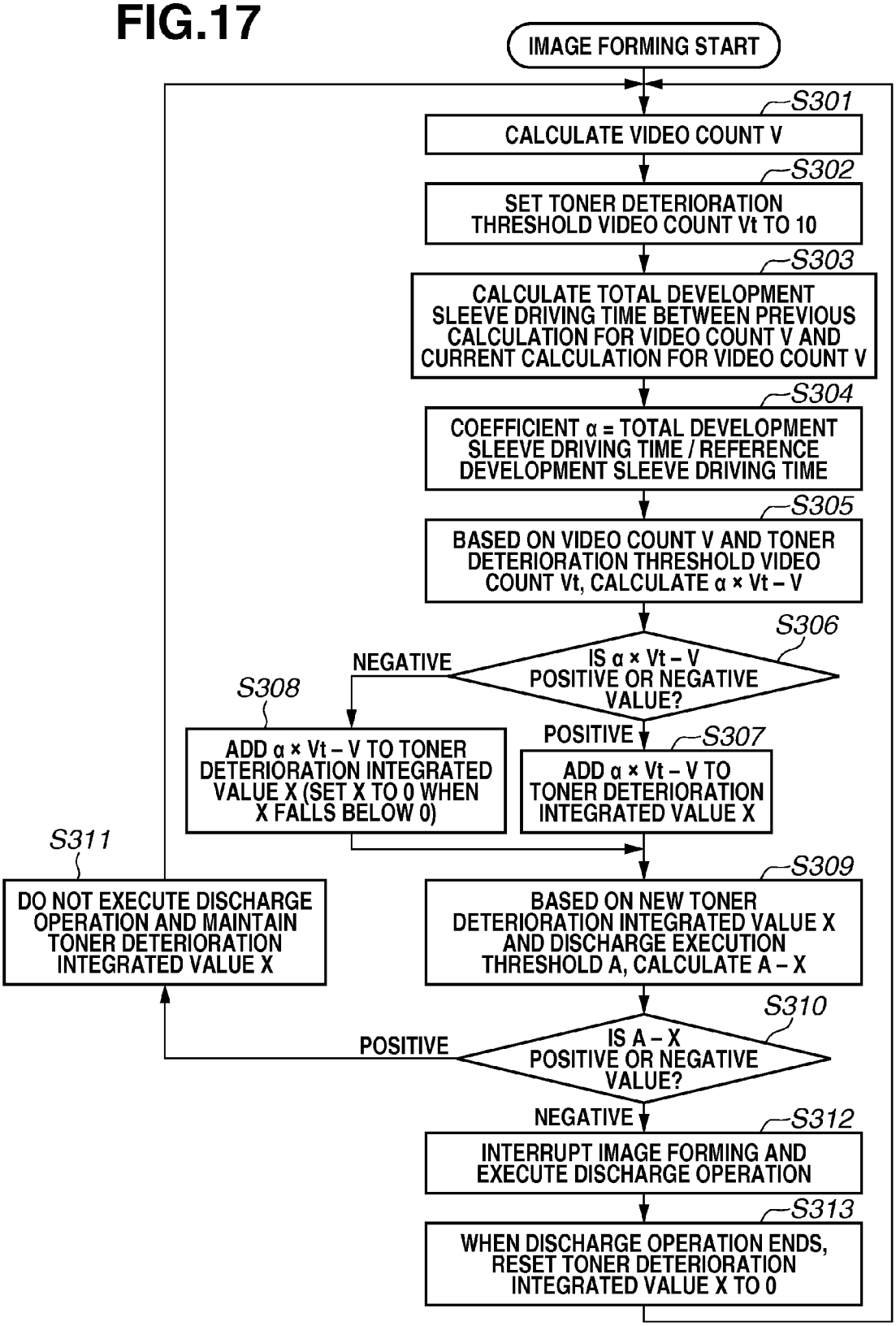
FIG. 17 is a flowchart illustrating toner refresh control (1) in the image forming apparatus according to a second exemplary embodiment.

In the first exemplary embodiment described above, the toner discharge control is described that is based on the toner consumption amount at every predetermined timing (every time printing is performed) during the image forming. In a second exemplary embodiment, toner refresh control is described that takes into account a case where interruption control such as patch density control is performed while the image forming is in process, and a case where the development sleeve 24 is driven while the image forming is not in process due to pre rotation as a preparation operation before the image forming operation and post rotation. The configuration and the basic concept of the toner forcible discharge are the same as those in the first exemplary embodiment and thus will not be described. A difference from the first exemplary embodiment is described with reference to a flowchart in FIG. 17.

The toner refresh control (1) will be described. A difference from the toner refresh control according to the first exemplary embodiment is described (steps S303 to S308), and the description for the rest of the processing is omitted. As illustrated in FIG. 9, in the first exemplary embodiment, the difference between the first toner deterioration threshold video count Vt and the video count V of each color is calculated. In the second exemplary embodiment, the toner refresh control is executed based on a development sleeve driving time coefficient α as driving information on the development sleeve 24. In step S303, the printer controller unit 209 calculates a development sleeve driving time between the previous calculation for the video count V and the current calculation for the video count V based on information of a development sleeve driving time detection unit 1011. In step S304, the development sleeve driving time coefficient α is calculated based on the information from the development sleeve driving time detection unit 1011. More specifically, the development sleeve driving time coefficient α is obtained by dividing a total development sleeve driving time, which is between a point where the previous video count V is calculated and a point where the current video count V is calculated, by a reference development sleeve driving time set in advance. The reference development sleeve driving time is defined as a driving time required for forming an image on a single sheet. Thus, when no interrupting control different from the image forming in process is performed during the image forming or when the development sleeve 24 is not driven during the interrupting control, the total development sleeve driving time is equal to the reference development sleeve driving time, and thus α=1.

Then, in the processing procedure up to step S305, calculation of the development sleeve driving time coefficient α×toner deterioration threshold video count Vt is performed. In step S306, whether αVt−V is a positive value or a negative value is determined. When α=1, 1×Vt−V and thus the calculation that is the same as that in the first exemplary embodiment is performed. The toner deterioration threshold video count Vt is multiplied by a because the toner deterioration proceeds in an amount proportional to an extended amount of the development sleeve driving time. When αVt−V is a positive value (POSITIVE in step S306), it means that the coverage rate is low and thus the toner deterioration proceeds, and the processing proceeds to step S307. Thus, in step S307, (αVt−V) is added to the toner deterioration integrated value X.

On the other hand, when αVt−V is a negative value (NEGATIVE in step S306), it means that an image with a high coverage rate is printed and thus the toner deterioration state is recovered by the toner exchange, and the processing proceeds to step S308. In step S308, the negative value is added to the toner deterioration integrated value X in consideration of the recovered amount. When the calculation is simply performed, the toner deterioration integrated value X might be reduced below 0. In such a case, the toner deterioration integrated value X is set to 0 because a quality higher than that in an initial state cannot be achieved even when the image with a high coverage rate is successively printed and thus the toner is frequently exchanged.

A flow of processing (steps S309 to S313) after the toner deterioration integrated value X is calculated is the same as that in the first exemplary embodiment, and thus will not be described.

When the toner is consumed during the interruption control by, for example, a density control patch, a toner supply control patch, a registration offset correction patch, and the like, the video count corresponding to the consumed amount of toner may be added to calculate the video count V.

Figure 18:
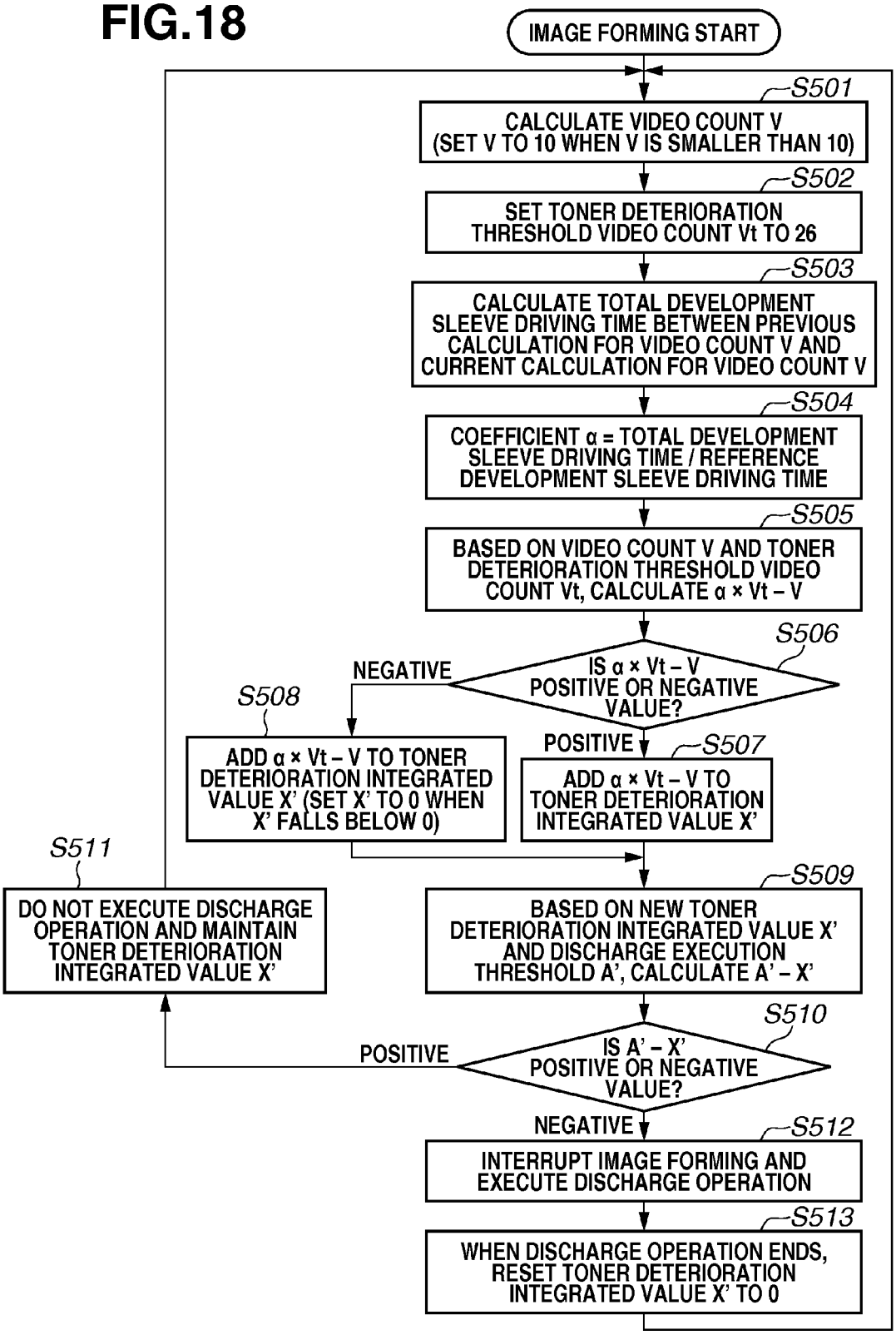
FIG. 18 is a flowchart illustrating toner refresh control (2) in the image forming apparatus according to the second exemplary embodiment.

Then, in the toner refresh control (2), the control is performed in consideration of the driving of the development sleeve 24 as in the toner refresh control (1), as illustrated in a flowchart in FIG. 18. The flow of the toner refresh control (2) according to the present exemplary embodiment is the same as the flow of the toner refresh control (2) according to the first exemplary embodiment and thus will not be described (except steps S503 to S508). A difference from the first exemplary embodiment is described (steps S503 to S508). As in the first exemplary embodiment illustrated in the flowchart in FIG. 15, the difference between the second toner deterioration threshold video count Vt and the video count V of each color is calculated. However, the second exemplary embodiment is different from the first exemplary embodiment in that processing of calculating the development sleeve driving time coefficient $\alpha$ is added (steps S503 to S508).

As described above, in the second exemplary embodiment, the control is executed based on the toner consumption amount corresponding to the sleeve driving time. Thus, the toner discharge control is appropriately executed in accordance with toner deterioration and the toner charging amount.

According to the present exemplary embodiment, in the toner refresh control (1) and the toner refresh control (2), the toner discharge control is executed based on the video count V and the development sleeve driving time coefficient $\alpha \times$toner deterioration threshold video count Vt. However, this should not be construed in a limiting sense. For example, $V/\alpha$ may be calculated each time and the toner discharge control may be executed based on the difference (positive or negative) between the toner deterioration threshold video count Vt and $V/\alpha$. Driving information on the development sleeve 24 is used as the driving time in the present exemplary embodiment, a driving amount (rotation amount) may be used.

In a third exemplary embodiment, the content of control described in the first and the second exemplary embodiments are partially modified in accordance with a temperature of an environment in which the developing device 4 is disposed. Thus, the toner discharge operation can be executed at an appropriate frequency in accordance with the toner deterioration level in the environment with the temperature and the toner charging amount state, so as not to be excessively or insufficiently executed.

When the temperature of the environment in which the developing device 4 is disposed is high, the toner deterioration rate is likely to become high with respect to the number of printed sheets. This is because the resin as the base toner is softened when the temperature rises, and the external additive becomes more likely to be separated or embedded due to a load in the developing device 4. Thus, in an environment where the temperature has risen, the toner refreshing needs to be executed in accordance of the resultant faster toner deterioration rate. In the third exemplary embodiment, the toner deterioration threshold video count Vt (the first toner deterioration threshold video count Vt in the present exemplary embodiment) is variable in accordance with the temperature in the developing device 4. As described above, the toner deterioration threshold video count Vt is a video count corresponding to the minimum toner consumption amount required for preventing the image quality from degrading due to the toner deterioration. When the toner and the developing device 4 described in the present exemplary embodiment are used, the first toner deterioration threshold video count Vt is changed in accordance with the temperature as follows. More specifically, Vt=10 (corresponding to the coverage rate of 2%) in an environment with a temperature not higher than 30° C., Vt=13 (corresponding to the coverage rate of 2.5%) in an environment with a temperature in a range of 30 to 35° C., Vt=16 (corresponding to the coverage rate of 3%) in an environment with a temperature in a range of 35 to 40° C., and Vt=18 (corresponding to the coverage rate of 3.5%) in an environment with a temperature in a range of 40 to 45° C.

Figure 16:
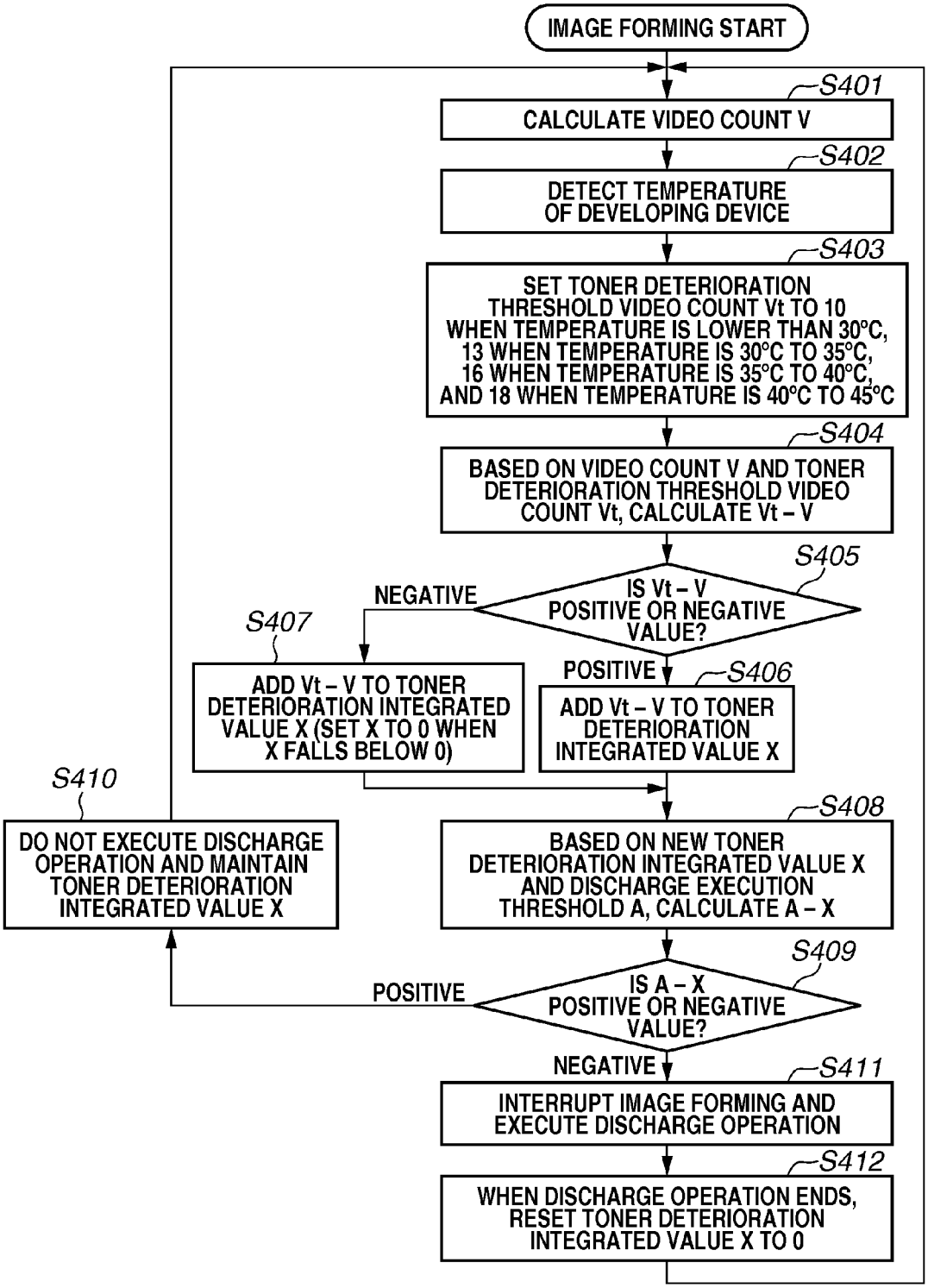
FIG. 16 is a flowchart illustrating toner refresh control (1) in the image forming apparatus according to a third exemplary embodiment.

In the third exemplary embodiment, the toner refresh control (1) for preventing the image failure when the low coverage rate images are successively formed, is executed as illustrated in a flowchart in FIG. 16. More specifically, in step S401, the video count V is calculated. In step S402, the temperature sensor 4T detects the temperature in the developing device 4. Then, in step S403, the first toner deterioration threshold video count Vt is set in accordance with the detection result obtained by the temperature sensor 4T. Then, the toner refresh control (1) is executed, based on the Vt and the video count V thus set, through a flow of processing that is the same as those in the first and the second exemplary embodiments. A flow of processing procedure after step S404 is the same as the processing procedure after step S3 in the first exemplary embodiment, and thus will not be described.

On the other hand, in the toner refresh control (2), the second toner deterioration threshold video count Vt is not changed in accordance with the temperature in the developing device 4. Thus, the toner refresh control (2) is executed through a flow of processing that is the same as those described in the first and the second exemplary embodiments. As described above, the toner refresh control (2) is executed to regulate the change in the toner charging amount, due to the change in the coverage rate, to be not larger than the predetermined value. The toner charging amount is highly sensitive to the time period during which the toner is stirred in the developing device 4 but is not very sensitive to the temperature in the developing device 4. Thus, the control is executed regardless of the temperature in the developing device 4, and thus is the same as those in the first and the second exemplary embodiments. The second toner deterioration threshold video count Vt may be changed in accordance with the temperature as in the toner refresh control (1). Still, the toner charging amount is not very sensitive to the temperature, and thus is preferably changed within a range smaller than a change range in the toner refresh control (1).

In the exemplary embodiments, the method is described where a negative value is added when a difference between the deterioration threshold Vt and the video count V is a negative value (a method of taking into account the developer deterioration recovering effect). Alternatively, when the Vt−V is a negative value, the Vt−V may be set to 0. In this case, the difference between the deterioration threshold Vt and the video count V is always a positive value, and only the count up is performed.

In the present exemplary embodiment, the video count is used as information on the toner consumption amount. However, this should not be construed in a limiting sense, and supply information may be used.

With the present invention, an image forming apparatus can be provided that can reduce the unnecessary toner consumption as much as possible, and the image quality can be prevented from degrading when the low coverage image forming is successively executed or is switched to the high coverage image forming.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-191455, filed Sep. 19, 2014, which is hereby incorporated by reference herein in its entirety.

What is claimed is:

1. An image forming apparatus for forming an image on a recording medium, the image forming apparatus comprising:

an image bearing member configured to bear an image;

a developing device configured to develop a latent image formed on the image bearing member with a toner;

a supplying device configured to supply toner to the developing device; and a control unit configured to execute a first discharge operation to discharge toner from the developing device to the image bearing member without transferring the toner onto a recording medium in a case of reaching a first threshold and a second discharge operation to discharge toner from the developing device to the image bearing member without transferring the toner onto a recording medium in a case of reaching a second threshold, wherein the control unit is capable of executing the first discharge operation after forming a plurality of images and is capable of executing the second discharge operation after forming a plurality of images, wherein the first threshold and the second threshold are set so that a frequency of first discharge operation becomes higher than a frequency of second discharge operation, and wherein an amount of toner on the image bearing member transferred from the developing device during the second discharge operation is larger than an amount of toner on the image bearing member transferred from the developing device during the first discharge operation executed.

2. The image forming apparatus according to claim 1, wherein the control unit executes the first discharge operation based on a difference between an information related to a toner consumption amount and a first deterioration threshold and the second discharge operation based on a difference between an information related to a toner consumption amount and a second deterioration threshold which is larger than the first deterioration threshold.

3. The image forming apparatus according to claim 2, wherein the control unit executes the first discharge operation in a case where an integrated value, obtained by integrating the difference between an information related to a toner consumption amount and a first deterioration threshold, reached the first threshold, and wherein the control unit executes the second discharge operation in a case where an integrated value, obtained by integrating the difference between an information related to a toner consumption amount and a second deterioration threshold, reached the second threshold.

4. The image forming apparatus according to claim 1, wherein the control unit executes the first discharge operation based on a difference between an information related to an image coverage rate and a first deterioration threshold and executes the second discharge operation based on a difference between an information related to an image coverage rate and a second deterioration threshold which is larger than the first deterioration threshold.

5. The image forming apparatus according to claim 4, wherein the control unit executes the first discharge operation in a case where an integrated value, obtained by integrating the difference between information related to an image coverage rate and a first deterioration threshold, reached the first threshold, and wherein the control unit executes the second discharge operation in a case where an integrated value, obtained by integrating the difference between information related to an image coverage rate and a second deterioration threshold, reached the second threshold.

6. The image forming apparatus according to claim 1, wherein the control unit executes the first and second discharge operations based on a driving information related to the developing device.

7. The image forming apparatus according to claim 1, wherein the control unit is configured to select a first mode which executes the first discharge operation and the second discharge operation and a second mode which executes the first discharge operation and does not execute the second discharge operation.

8. The image forming apparatus according to claim 1, wherein the control unit is configured to selectively execute a first mode in which the discharge operation is executed based on a first deterioration threshold and a second deterioration threshold and a second mode in which the discharge operation based on the first deterioration threshold is executed and the discharge operation based on the second deterioration threshold is not executed.

9. The image forming apparatus according to claim 1, wherein each of the frequency of first discharge operation and the frequency of second discharge operation is determined based on an information related to image coverage rate.

10. The image forming apparatus according to claim 1, wherein each of the frequency of first discharge operation and the frequency of second discharge operation is determined based on an information related to a toner consumption amount.

11. The image forming apparatus according to claim 1, wherein the control unit is configured to selectively execute a first mode in which the discharge operation is executed based on a first deterioration threshold and a second deterioration threshold and a second mode in which the discharge operation based on the first deterioration threshold is executed and the discharge operation based on the second deterioration threshold is not executed.

12. The image forming apparatus according to claim 1, wherein, in case of continuously forming a plurality of images, the control unit is capable of executing the first discharge operation while interrupting continuously forming images.

13. The image forming apparatus according to claim 1, wherein, in case of continuously forming a plurality of images, the control unit is capable of executing the second discharge operation while interrupting continuously forming images.

14. An image forming apparatus for forming an image on a recording medium, the image forming apparatus comprising:

an image bearing member configured to bear an image;

a developing device configured to develop a latent image formed on the image bearing member with a toner;

a supplying device configured to supply toner to the developing device; and a control unit configured to execute a first discharge operation to discharge toner from the developing device to the image bearing member without transferring the toner onto a recording medium in a case of reaching a first threshold and a second discharge operation to discharge toner from the developing device to the image bearing member without transferring the toner onto a recording medium in a case of reaching a second threshold, wherein the control unit is capable of executing the first discharge operation after forming a plurality of images and is capable of executing the second discharge operation after forming a plurality of images, wherein an amount of toner on the image bearing member transferred from the developing device during the second discharge operation is larger than an amount of toner on the image bearing member transferred from the developing device during the first discharge operation executed, and wherein, in case of continuously forming a plurality of images having an image coverage rate that is less than a predetermined value, the control unit is capable of executing the first discharge operation after reaching the first threshold from starting a continuous image formation, and the second discharge operation after reaching the second threshold and executing multiple the first discharge operations.

15. The image forming apparatus according to claim 14, wherein the image coverage rate is less than two percent.

16. The image forming apparatus according to claim 14, wherein, in case of continuously forming a plurality of images, the control unit is capable of executing the first discharge operation while interrupting continuously forming images.

17. The image forming apparatus according to claim 14, wherein, in case of continuously forming a plurality of images, the control unit is capable of executing the second discharge operation while interrupting continuously forming images.

18. An image forming apparatus for forming an image on a recording medium, the image forming apparatus comprising:

an image bearing member configured to bear an image;

a developing device configured to develop a latent image formed on the image bearing member with a toner;

a supplying device configured to supply toner to the developing device; and a control unit configured to execute a first discharge operation to discharge toner from the developing device to the image bearing member without transferring the toner onto a recording medium in a case of reaching a first threshold and a second discharge operation to discharge toner from the developing device to the image bearing member without transferring the toner onto a recording medium in a case of reaching a second threshold, wherein the control unit is capable of executing the first discharge operation after forming a plurality of images and is capable of executing the second discharge operation after forming a plurality of images, wherein the first threshold and the second threshold are set so that a frequency of first discharge operation becomes higher than a frequency of second discharge operation in a case of continuously forming a plurality of a predetermined image having an image coverage rate that is less than a predetermined value and wherein an amount of toner on the image bearing member transferred from the developing device during the second discharge operation is larger than an amount of toner on the image bearing member transferred from the developing device during the first discharge operation executed.

19. The image forming apparatus according to claim 18, wherein the control unit executes the first discharge operation based on a difference between an information related to a toner consumption amount and a first deterioration threshold and the second discharge operation based on a difference between an information related to a toner consumption amount and a second deterioration threshold which is larger than the first deterioration threshold.

20. The image forming apparatus according to claim 19, wherein the control unit executes the first discharge operation in a case where an integrated value, obtained by integrating the difference between an information related to a toner consumption amount and a first deterioration threshold, reached the first threshold, and wherein the control unit executes the second discharge operation in a case where an integrated value, obtained by integrating the difference between an information related to a toner consumption amount and a second deterioration threshold, reached the second threshold.

21. The image forming apparatus according to claim 18, wherein the control unit executes the first discharge operation based on a difference between an information related to an image coverage rate and a first deterioration threshold and executes the second discharge operation based on a difference between an information related to an image coverage rate and a second deterioration threshold which is larger than the first deterioration threshold.

22. The image forming apparatus according to claim 21, wherein the control unit executes the first discharge operation in a case where an integrated value, obtained by integrating the difference between information related to an image coverage rate and a first deterioration threshold, reached the first threshold, and wherein the control unit executes the second discharge operation in a case where an integrated value, obtained by integrating the difference between information related to an image coverage rate and a second deterioration threshold, reached the second threshold.

23. The image forming apparatus according to claim 18, wherein the control unit executes the first and second discharge operations based on a driving information related to the developing device.

24. The image forming apparatus according to claim 18, wherein the control unit is configured to select a first mode which executes the first discharge operation and the second discharge operation and a second mode which executes the first discharge operation and does not execute the second discharge operation.

25. The image forming apparatus according to claim 18, wherein each of the frequency of first discharge operation and the frequency of second discharge operation is determined based on an information related to image coverage rate.

26. The image forming apparatus according to claim 18, wherein each of the frequency of first discharge operation and the frequency of second discharge operation is determined based on an information related to a toner consumption amount.

27. The image forming apparatus according to claim 18, wherein, in case of continuously forming a plurality of images, the control unit is capable of executing the first discharge operation while interrupting continuously forming images.

28. The image forming apparatus according to claim 18, wherein, in case of continuously forming a plurality of images, the control unit is capable of executing the second discharge operation while interrupting continuously forming images.

29. An image forming apparatus for forming an image on a recording medium, the image forming apparatus comprising:

an image bearing member configured to bear an image;

a developing device configured to develop a latent image formed on the image bearing member with a toner;

a supplying device configured to supply toner to the developing device; and a control unit configured to execute a first discharge operation to discharge toner from the developing device to the image bearing member without transferring the toner onto a recording medium after forming a plurality of images and a second discharge operation to discharge toner from the developing device to the image bearing member without transferring the toner onto a recording medium after forming a plurality of images, wherein an amount of toner on the image bearing member transferred from the developing device during the second discharge operation is larger than an amount of toner on the image bearing member transferred from the developing device during the first discharge operation executed, wherein, in case of continuously forming a plurality of images having a first image coverage rate that is less than a predetermined value, the control unit is capable of executing multiple first discharge operations from an end of execution of the second discharge operation to a start of a next execution of the second discharge operation, and wherein, in case of continuously forming a plurality of images having a second image coverage rate that is more than the predetermined value, the control unit executes the second discharge operation and does not execute the first discharge operation from an end of execution of the second discharge operation to a start of a next execution of the second discharge operation.

30. The image forming apparatus according to claim 29, wherein the predetermined first image coverage rate is less than two percent.

31. The image forming apparatus according to claim 29, wherein the control unit executes the second discharge operation after executing multiple first discharge operations.

32. The image forming apparatus according to claim 29, wherein, in case of continuously forming a plurality of images, the control unit is capable of executing the first discharge operation while interrupting continuously forming images.

33. The image forming apparatus according to claim 29, wherein, in case of continuously forming a plurality of images, the control unit is capable of executing the second discharge operation while interrupting continuously forming images.

* * * * *